US009176431B2

(12) United States Patent
Koike et al.

(10) Patent No.: US 9,176,431 B2
(45) Date of Patent: Nov. 3, 2015

(54) DEVELOPING DEVICE AND IMAGE FORMING APPARATUS AND PROCESS CARTRIDGE INCORPORATING SAME

(71) Applicants: Toshio Koike, Tokyo (JP); Kiyonori Tsuda, Kanagawa (JP); Yutaka Takahashi, Kanagawa (JP); Yuichi Aizawa, Ibaraki (JP); Keinosuke Kondoh, Kanagawa (JP); Kentaro Mikuniya, Tokyo (JP)

(72) Inventors: Toshio Koike, Tokyo (JP); Kiyonori Tsuda, Kanagawa (JP); Yutaka Takahashi, Kanagawa (JP); Yuichi Aizawa, Ibaraki (JP); Keinosuke Kondoh, Kanagawa (JP); Kentaro Mikuniya, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/451,968

(22) Filed: Aug. 5, 2014

(65) Prior Publication Data

US 2015/0078788 A1 Mar. 19, 2015

(30) Foreign Application Priority Data

Sep. 13, 2013 (JP) ..... 2013-191055

(51) Int. Cl.
*G03G 15/09* (2006.01)

(52) U.S. Cl.
CPC ..... *G03G 15/0907* (2013.01); *G03G 15/0921* (2013.01)

(58) Field of Classification Search
CPC ..... G03G 15/0907; G03G 15/0928
See application file for complete search history.

(56) References Cited

U.S. PATENT DOCUMENTS

| | | | | |
|---|---|---|---|---|
| 4,780,743 | A * | 10/1988 | Asada et al. | 399/284 |
| 5,832,350 | A | 11/1998 | Kumasaka et al. | |
| 6,031,239 | A | 2/2000 | Shi et al. | |
| 6,128,449 | A * | 10/2000 | Zenba et al. | 399/50 |
| 2002/0176931 | A1 * | 11/2002 | Goseki et al. | 427/140 |
| 2010/0034564 | A1 * | 2/2010 | Horie et al. | 399/285 |

FOREIGN PATENT DOCUMENTS

| | | |
|---|---|---|
| JP | 7-191544 | 7/1995 |
| JP | 8-286516 | 11/1996 |
| JP | 9-251237 | 9/1997 |
| JP | 10-012431 | 1/1998 |
| JP | 2010-020281 | 1/2010 |
| JP | 2012-168225 | 9/2012 |

* cited by examiner

*Primary Examiner* — Gregory H Curran
(74) *Attorney, Agent, or Firm* — Oblon, McClelland, Maier & Neustadt, L.L.P.

(57) ABSTRACT

A developing device includes a developer bearer to carry, by rotation, developer including toner and magnetic carrier to a development range facing a latent image bearer, and the developer bearer includes a magnetic field generator having multiple magnetic poles and a cylindrical developing sleeve to rotate and bear developer on an outer circumferential face thereof with magnetic force of the magnetic field generator provided inside the developing sleeve. The developing sleeve receives developing bias voltage including an AC component, and includes a base to maintain a cylindrical shape of the developing sleeve and a low friction surface layer including a material lower in friction coefficient with toner than a material of the base.

7 Claims, 14 Drawing Sheets

DEVELOPING DEVICE AND IMAGE FORMING APPARATUS AND PROCESS CARTRIDGE INCORPORATING SAME

CROSS-REFERENCE TO RELATED APPLICATIONS

This patent application is based on and claims priority pursuant to 35 U.S.C. §119(a) to Japanese Patent Application No. 2013-191055, filed on Sep. 13, 2013, in the Japan Patent Office, the entire disclosure of which is hereby incorporated by reference herein.

BACKGROUND

1. Technical Field

Embodiments of the present invention generally relate to a developing device, a process cartridge, and an image forming apparatus, such as a copier, a printer, a facsimile machine, or a multifunction machine (i.e., a multifunction peripheral) having at least two of copying, printing, facsimile transmission, plotting, and scanning capabilities, that includes a developing device.

2. Description of the Related Art

Generally, image forming apparatuses include a developing device to develop latent images formed on a latent image bearer with developer. For example, there are two-component developing devices that employ two-component developer consisting essentially of toner particles and carrier particles to develop the latent image on the latent image bearer. In two-component developing devices, a range where a developing sleeve, serving as a developer bearer, faces the latent image bearer, such as a photoreceptor, is called a development range. A magnetic field generator provided inside the developing sleeve generates a magnetic field that causes developer particles to stand on end, in the form of a magnetic brush, on the developing sleeve, and the magnetic brush contacts the latent image bearer in the development range. Thus, toner is supplied to the latent image on the latent image bearer, developing it into a toner image.

Additionally, on the surface of the developing sleeve downstream from the development range in the direction in which the developing sleeve rotates, the magnetic field generator exerts magnetic force to separate carrier particles from the developing sleeve. At that time, toner particles adhering to the carrier particles leave the developing sleeve as well. As the developing sleeve rotates further, the surface of the developing sleeve reaches a developer supply position where the developing sleeve is supplied with developer.

In such two-component developing devices, it is possible that history of a preceding image is inherited to a subsequent image, and the amount of toner on the latent image bearer fluctuates, resulting in image failure called "ghost images", in which image density fluctuates.

For example, in ghost images (also called "afterimages") that arise when solid images are formed by the two-component developing device, the image density is higher in a portion corresponding to a first rotation of the developing sleeve. It is known that the ghost image may be caused by the developer used for the preceding image and remaining on an outer surface of the developing sleeve. Ghost images may be inhibited by reducing the amount of developer remaining on the outer surface of the developing sleeve. For that, it is conceivable that the developing sleeve is provided with a low friction surface layer lower in friction coefficient with toner than a base material of the developing sleeve.

SUMMARY

An embodiment of the present invention provides a developing device that includes a developer bearer to carry, by rotation, developer including toner and magnetic carrier to a development range facing a latent image bearer to bear a latent image. The developer bearer includes a magnetic field generator having multiple magnetic poles, and a cylindrical developing sleeve to rotate and receive developing bias voltage including an AC component. With magnetic force of the magnetic field generator provided inside the developing sleeve, developer is borne on an outer circumferential face of the developing sleeve. The developing sleeve includes a base that maintains a cylindrical shape of the developing sleeve, and a low friction surface layer including a material lower in friction coefficient with toner than a material of the base.

In another embodiment, a process cartridge removably installed in an image forming apparatus includes the latent image bearer, the above-described developing device, and a common unit casing to hold the latent image bearer and the developing device as a single unit.

In yet another embodiment, an image forming apparatus includes the latent image bearer, the above-described developing device, and a voltage application device to apply, to the developing sleeve, developing bias voltage including an AC component.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
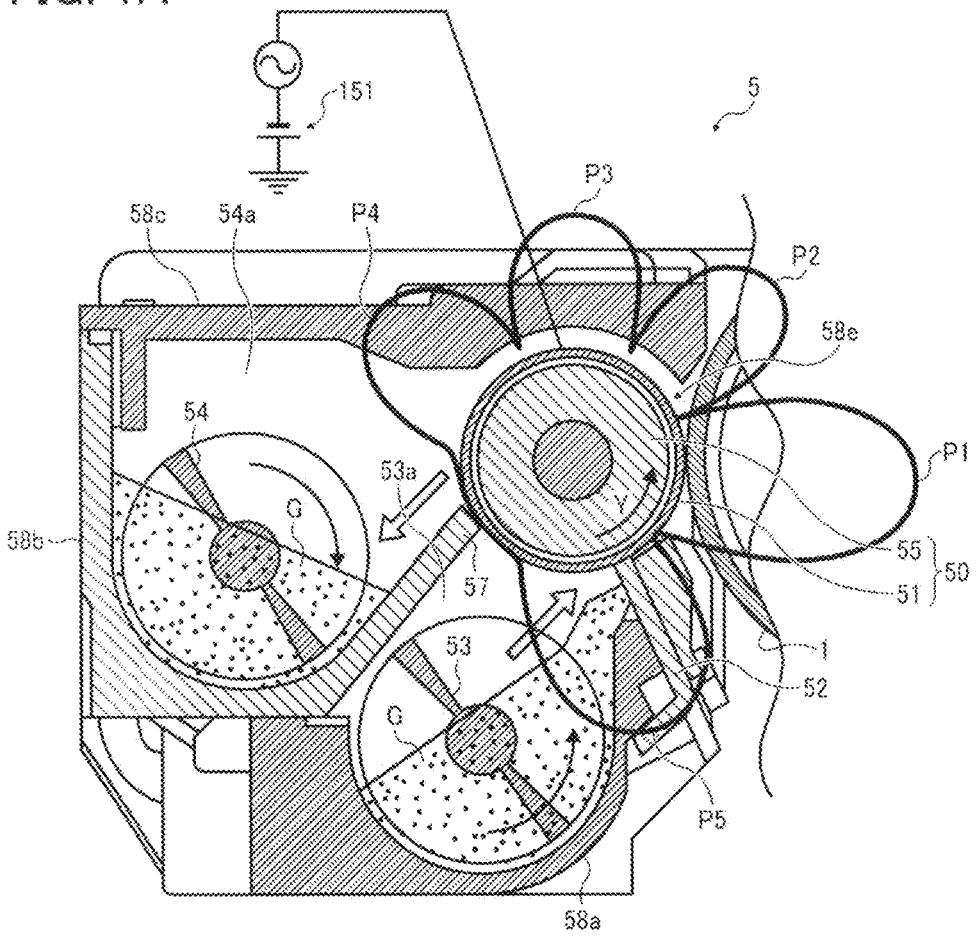
FIG. 1A is a cross-sectional view of a developing device according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, a developing device according to an embodiment of the present invention and a multicolor image forming apparatus in which the developing device is incorporated is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Initially, an image forming apparatus 500 according to an embodiment is described below.

Figure 2:
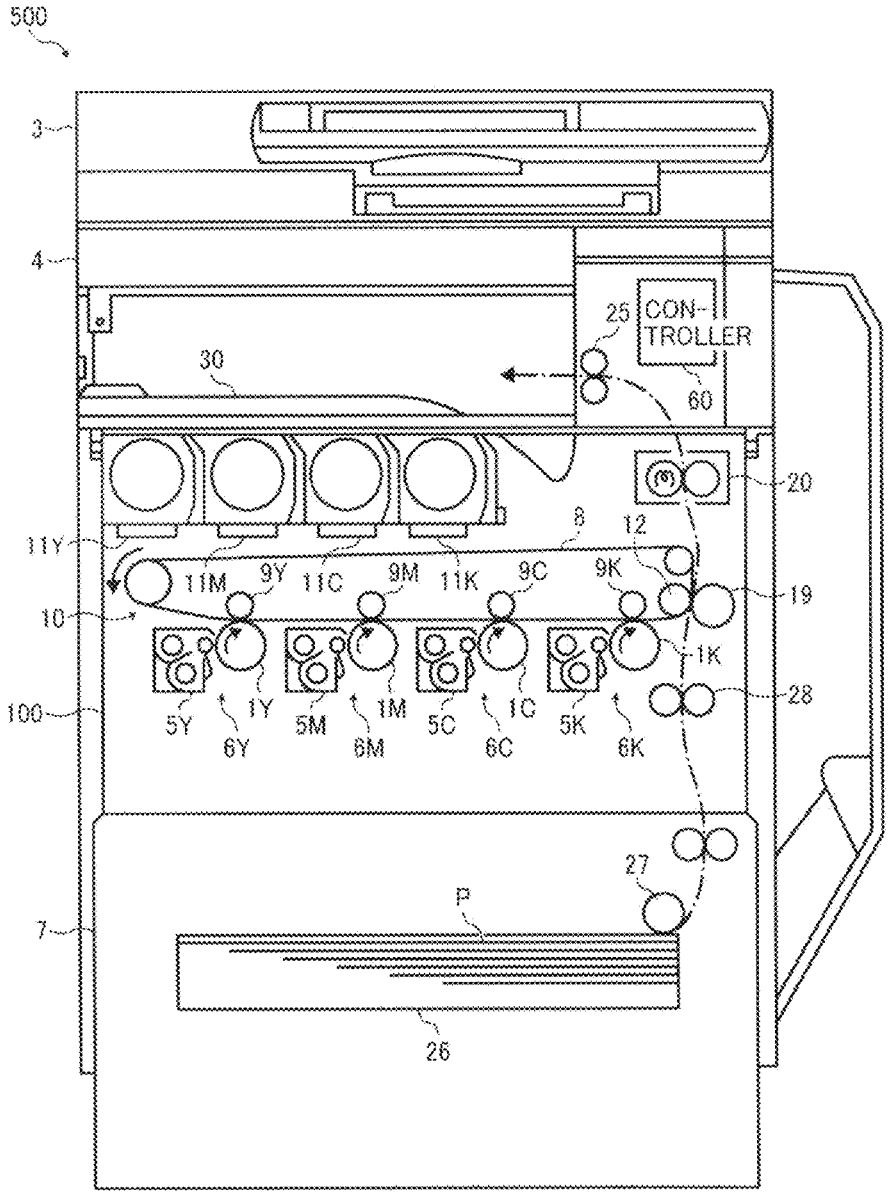
FIG. 2 is a schematic diagram illustrating an image forming apparatus according to an embodiment.

FIG. 2 is a schematic diagram that illustrates a configuration of the image forming apparatus 500. For example, the image forming apparatus 500 in the present embodiment is a tandem-type multicolor copier.

The image forming apparatus 500 includes a printer unit 100 that is an apparatus body, a document reading unit 4 and a document feeder 3, both disposed above the printer unit 100, and a sheet feeding unit 7 disposed beneath the printer unit 100. The document feeder 3 feeds originals to the document reading unit 4, and the document reading unit 4 reads image data of the originals. The sheet feeding unit 7 is a sheet container that contains sheets P (transfer sheets) of recording media and includes a sheet tray 26 in which the sheets P are stored and a feed roller 27 to feed the sheets P from the sheet tray 26 to the printer unit 100. It is to be noted that broken lines shown in FIG. 1 represent a conveyance path through which the sheet P is transported inside the image forming apparatus 500.

A discharge tray 30 on which output images are stacked is provided on an upper side of the printer unit 100. The printer unit 100 includes four image forming units 6Y, 6M, 6C, and 6K for forming yellow, magenta, cyan, and black toner images, respectively, and an intermediate transfer unit 10. Each image forming unit 6 includes a drum-shaped photoreceptor 1 serving as both a latent image bearer to bear a latent image and an image bearer to bear a toner image, and a developing device 5 to develop an electrostatic latent image on the photoreceptor 1 into the toner image.

The image forming units 6Y, 6M, 6C, and 6K respectively corresponding to yellow, magenta, cyan, and black are arranged in parallel, facing an intermediate transfer belt 8 of an intermediate transfer unit 10.

The intermediate transfer unit 10 includes four primary-transfer bias rollers 9Y, 9M, 9C, and 9K in addition to the intermediate transfer belt 8. The intermediate transfer belt 8 serves as an intermediate transfer member onto which the toner images are transferred from the respective photoreceptors 1, and the toner images are superimposed one on another thereon, thus forming a multicolor toner image. The primary-transfer bias rollers 9 serve as primary-transfer members to primarily transfer the toner images on the photoreceptors 1 onto the intermediate transfer belt 8.

The printer unit 100 further includes a secondary-transfer bias roller 19 to transfer the multicolor toner image from the intermediate transfer belt 8 onto the sheet P. Further, a pair of registration rollers 28 is provided to suspend the transport of the sheet P and adjust the timing to transport the sheet P to a secondary-transfer nip between the intermediate transfer belt 8 and the secondary-transfer bias roller 19 pressed against it. The printer unit 100 further includes a fixing device 20 disposed above the secondary-transfer nip to fix the toner image on the sheet P.

Additionally, toner containers 11Y, 11M, 11C, and 11K for containing respective color toners supplied to the developing devices 5 are provided inside the printer unit 100, beneath the discharge tray 30 and above the intermediate transfer unit 10.

Figure 3:
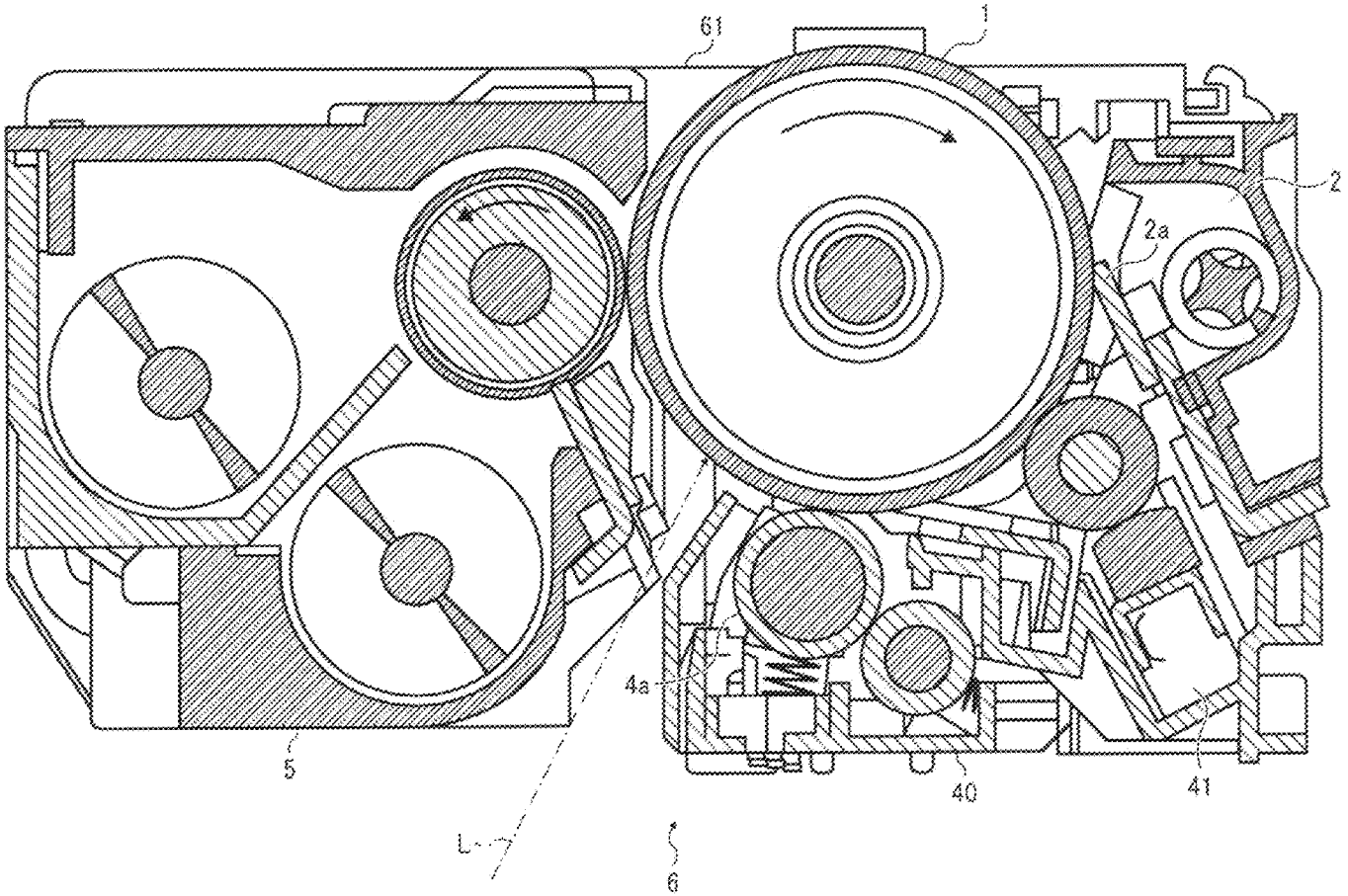
FIG. 3 is a schematic end-on axial view of an image forming unit of the image forming apparatus shown in FIG. 2.

FIG. 3 is an enlarged view of one of the four image forming units 6. The four image forming units 6 have a similar configuration except the color of toner used therein, and the suffixes Y, M, C, and K are omitted in FIG. 3.

In the configuration shown in FIG. 3, the image forming unit 6 includes a common unit casing 61 to support the photoreceptor 1 and the developing device 5 and is configured as a modular unit (i.e., a process cartridge or process unit) removably installable in the apparatus body of the image forming apparatus 500. This configuration can facilitate replacement of the developing device 5 in the apparatus body, thus facilitating maintenance work.

Alternatively, in the image forming unit 6, the photoreceptor 1, the charging device 40, the developing device 5, and the cleaning unit 2 may be united into a modular unit removably installable in the image forming apparatus 500. Yet alternatively, the photoreceptor 1, the charging device 40, the developing device 5, and the cleaning unit 2 can be configured to be independently installed and removed from the apparatus body. In this case, each of them is replaced with a new one when its operational life expires.

As shown in FIGS. 2 and 3, the image forming unit 6 includes the developing device 5, a cleaning unit 2, a lubrication device 41, and a charging device 40 arranged in that order around the photoreceptor 1. In the image forming unit 6 according to the present embodiment, the cleaning unit 2 employs a cleaning blade 2*a*, and the charging device 40 employs a charging roller 4*a*.

In image formation, toner images are formed on the photoreceptor 1 through image forming processes, namely, charging, exposure, development, transfer, and cleaning processes.

Operations of the image forming apparatus 500 to form multicolor images are described below.

When a start button is pressed with originals set on a document table of the document feeder 3, conveyance rollers provided in the document feeder 3 transport the originals from the document table onto an exposure glass (contact glass) of the document reading unit 4. Then, the document reading unit 4 reads image data of the original set on the exposure glass optically.

More specifically, the document reading unit 4 scans the image of the original with light emitted from an illumination lamp. The light reflected from the surface of the original is imaged on a color sensor via mirrors and lenses. The color sensor reads the multicolor image data of the original for each of decomposed colors of red, green, and blue (RGB), and converts the image data into electrical image signals. Further, the image signals are transmitted to an image processor that performs image processing (e.g., color conversion, color calibration, and spatial frequency adjustment) according to the image signals, and thus image data of yellow, magenta, cyan, and black are obtained.

Then, the image data of yellow, magenta, cyan, and black are transmitted to an exposure device. The exposure device directs laser beams L to surfaces of the respective photoreceptors 1 according to image data of respective colors.

Meanwhile, the four photoreceptors 1 are rotated by a driving motor clockwise in FIGS. 2 and 3. The surface of the photoreceptor 1 is charged uniformly at a position facing the charging roller 4*a* of the charging device 40 (a charging process). Thus, charge potential is given to the surface of each photoreceptor 1. Subsequently, the surface of the photoreceptor 1 thus charged reaches a position to receive the laser beam L emitted from the exposure device.

Then, the laser beams L according to the respective color image data are emitted from four light sources of the exposure device. The laser beams pass through different optical paths for yellow, magenta, cyan, and black and reach the surfaces of the respective photoreceptors 1 (an exposure process).

In the case of yellow, the laser beam L corresponding to the yellow component is directed to the photoreceptor 1Y that is the first from the left in FIG. 2 among the four photoreceptors 1. A polygon mirror that rotates at high velocity deflects the laser beam L for yellow in a direction of a rotation axis of the photoreceptor 1Y (main scanning direction) so that the laser beam L scans the surface of the photoreceptor 1Y. With the scanning of the laser beam L, an electrostatic latent image for yellow is formed on the photoreceptor 1Y charged by the charging device 40.

Similarly, the laser beam L corresponding to the magenta component is directed to the surface of the photoreceptor 1M that is the second from the left in FIG. 2, thus forming an electrostatic latent image for magenta thereon. The laser beam L corresponding to the cyan component is directed to the surface of the photoreceptor 1C that is the third from the left in FIG. 2, thus forming an electrostatic latent image for cyan thereon. The laser beam L corresponding to the black component is directed to the surface of the photoreceptor 1K that is the fourth from the left in FIG. 2, thus forming an electrostatic latent image for black thereon.

Subsequently, the surface of the photoreceptor 1 bearing the electrostatic latent image is further transported to the position facing the developing device 5. At that position, the developing device 5 to contain developer including toner (toner particles) and carrier (carrier particles) supplies toner to the surface of the photoreceptor 1, thus developing the latent image thereon (a development process). Then, a toner image is formed on the photoreceptor 1.

Subsequently, the surfaces of the respective photoreceptors 1 reach positions facing the intermediate transfer belt 8, where the respective primary-transfer bias rollers 9 are provided in contact with an inner circumferential face of the intermediate transfer belt 8 The primary-transfer bias rollers 9 face the respective photoreceptors 1 via the intermediate transfer belt 8, and contact portions therebetween are called primary-transfer nips, where the single-color toner images are transferred from the respective photoreceptors 1 and superimposed one on another on the intermediate transfer belt 8 (a transfer process). After the primary-transfer process, a certain amount of toner tends to remain on the photoreceptor 1.

Subsequently, the surface of the photoreceptor 1 reaches a position facing the cleaning unit 2, where the cleaning blade 2*a* scraps off toner remaining on the photoreceptor 1 (a cleaning process).

Subsequently, a discharger removes electrical potential remaining on the surface of the photoreceptor 1.

Thus, a sequence of image forming processes performed on the photoreceptor 1 is completed, and the photoreceptor 1 is prepared for subsequent image formation.

The image forming units 6 shown in FIG. 2 perform the above-described image forming processes, respectively. That is, the exposing device disposed beneath the image forming units 6 in FIG. 2 directs laser beams L according to image data onto the photoreceptors 1 in the respective image forming units 6. Specifically, the exposing device includes light sources to emit the laser beams L, multiple optical elements, and the polygon mirror that is rotated by a motor. The exposing device directs the laser beams L to the respective photoreceptors 1 via the multiple optical elements while deflecting the laser beams L with the polygon mirror. Then, the toner images on the respective photoreceptors 1 through the development process are transferred therefrom and superimposed one on another on the intermediate transfer belt 8. Thus, a multicolor toner image is formed on the intermediate transfer belt 8.

As described above, the four primary-transfer bias rollers 9 are configured to press against the corresponding photoreceptors 1 via the intermediate transfer belt 8, and four contact portions between the primary-transfer bias rollers 9 and the corresponding photoreceptors 1 serve as the primary-transfer nips. Each primary-transfer bias roller 9 receives a transfer bias whose polarity is opposite the charge polarity of the toner.

While rotating in a direction indicated by an arrow shown in FIG. 2, the intermediate transfer belt 8 sequentially passes through the respective primary-transfer nips. Then, the single-color toner images are transferred from the respective photoreceptors 1 primarily and superimposed one on another on the intermediate transfer belt 8.

The intermediate transfer belt 8 carrying the superimposed single-color toner images (a multicolor toner image) transferred from the four photoreceptors 1 rotates counterclockwise in FIG. 2 and reaches a position facing the secondary-transfer bias roller 19. A secondary-transfer backup roller 12 and the secondary-transfer bias roller 19 press against each other via the intermediate transfer belt 8, and the contact portion therebetween serves as the secondary-transfer nip.

Additionally, the feed roller 27 sends out the sheet P from the sheet tray 26, and the sheet P is then guided by a sheet guide to the registration rollers 28. The sheet P is caught in the nip between the registration rollers 28 and stopped. Then, the registration rollers 28 forward the sheet P to the secondary-transfer nip, timed to coincide with the multicolor toner on the intermediate transfer belt 8.

More specifically, the sheet tray 26 contains multiple sheets P (i.e., transfer sheets), serving as recording media, piled one on another. The feed roller 27 rotates counterclockwise in FIG. 2 to feed the sheet P on the top contained in the sheet tray 26 toward a nip between the registration rollers 28. The registration rollers 28 stop rotating temporarily, stopping the sheet P with a leading edge of the sheet P stuck in the nip therebetween. The registration rollers 28 resume rotation to transport the sheet P to the secondary-transfer nip, timed to coincide with the arrival of the multicolor toner image on the intermediate transfer belt 8.

In the secondary-transfer nip, the multicolor toner image is transferred from the intermediate transfer belt 8 onto the sheet P (a secondary-transfer process). A certain amount of toner tends to remain on the intermediate transfer belt 8 after the secondary-transfer process.

Subsequently, the intermediate transfer belt 8 reaches a position facing the belt cleaning unit, where toner remaining on the intermediate transfer belt 8 is collected by the belt cleaning unit. Thus, a sequence of transfer processes performed on the intermediate transfer belt 8 is completed. Thus, a sequence of image forming processes performed on the intermediate transfer belt 8 is completed.

The sheet P carrying the multicolor toner image is sent to the fixing device 20. In the fixing device 20, a fixing belt and a pressing roller are pressed against each other. In a fixing nip therebetween, the toner image is fixed on the sheet P with heat and pressure (i.e., a fixing process).

Then, the sheet P is transported by a pair of discharge rollers 25, discharged outside the apparatus body as an output image, and stacked on the discharge tray 30 sequentially.

Thus, a sequence of image forming processes performed in the image forming apparatus 500 is completed.

Next, a configuration and operation of the developing device 5 of the image forming unit 6 are described in further detail below with reference to FIGS. 1A, 1B, 4, and 5.

Figure 6:
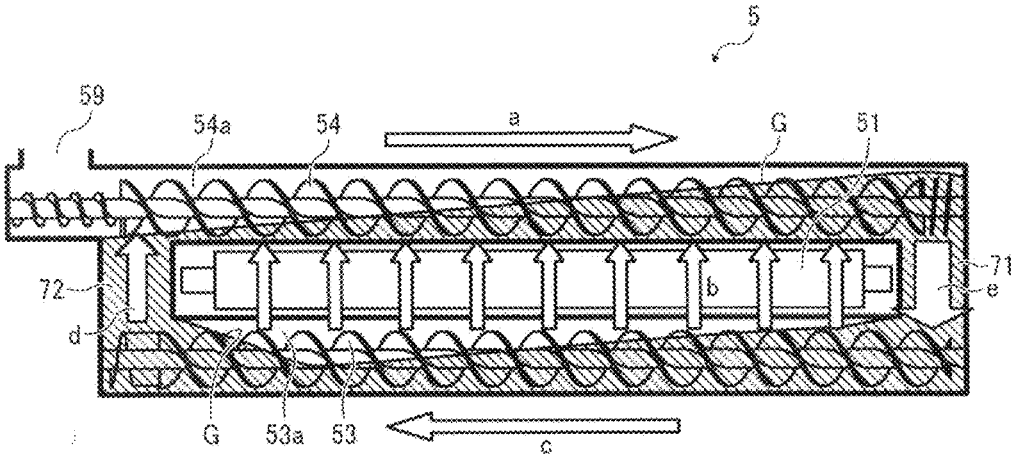
FIG. 6 is a schematic diagram illustrating movement of developer and an accumulation state of developer in the longitudinal direction (axial direction) inside the developing device shown in FIG. 1A.

It is to be noted that reference character G shown in FIGS. 1A and 6 represents developer contained in the developing device 5.

Figure 1B:
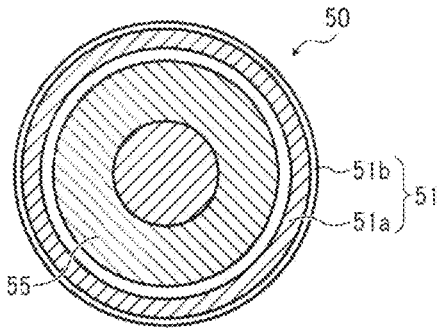
FIG. 1B is a cross-sectional view of a developing roller of the developing device shown in FIG. 1A.

FIG. 1A is a cross-sectional view of the developing device 5 according to the present embodiment, and FIG. 1B is an enlarged cross-sectional view of a developing roller 50 of the developing device 5. The developing device 5 includes a casing 58 to contain developer. The casing 58 includes a lower case 58*a*, an upper case 58*b*, and a development cover 58*c*.

Figure 4:
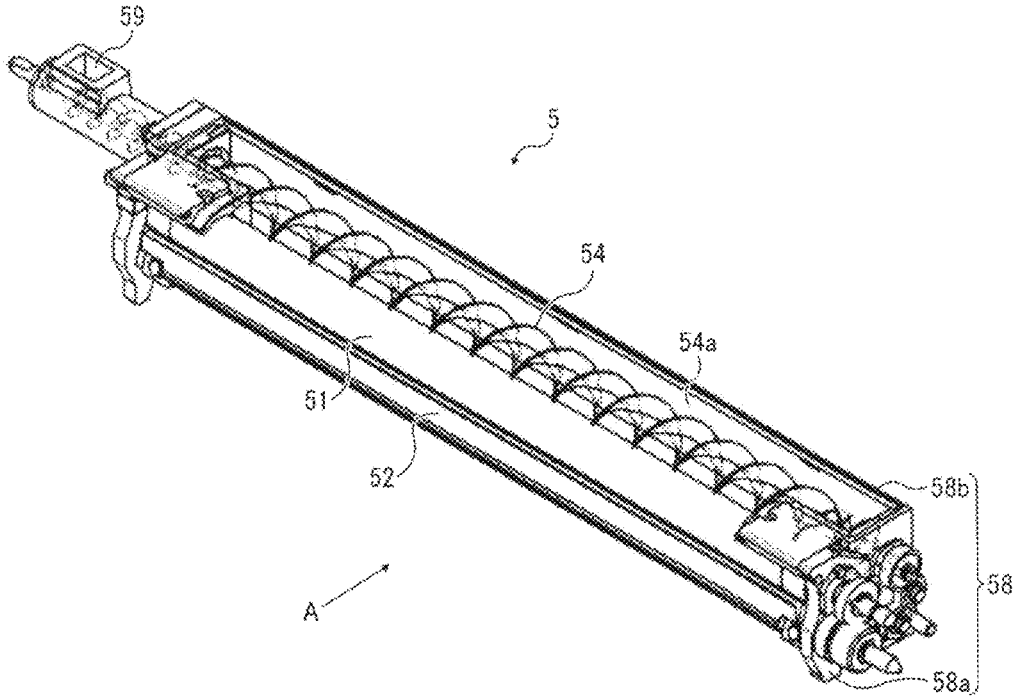
FIG. 4 is a perspective view illustrating the developing device from which a development cover is removed.
Figure 5A:
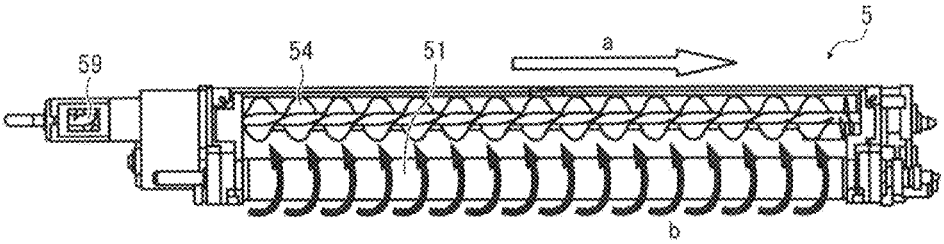
FIG. 5A is a top view of the developing device shown in FIG. 1A, from which the development cover is removed.
Figure 5B:
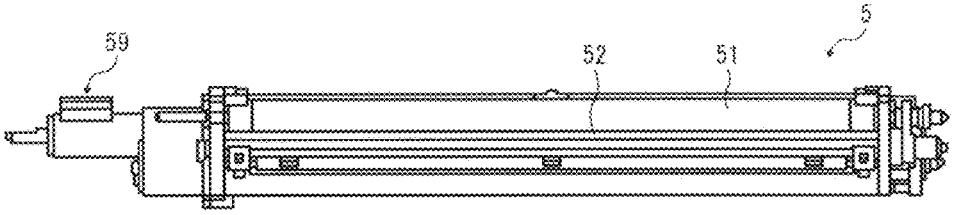
FIG. 5B is a side view of the developing device shown in FIG. 5A.
Figure 5C:
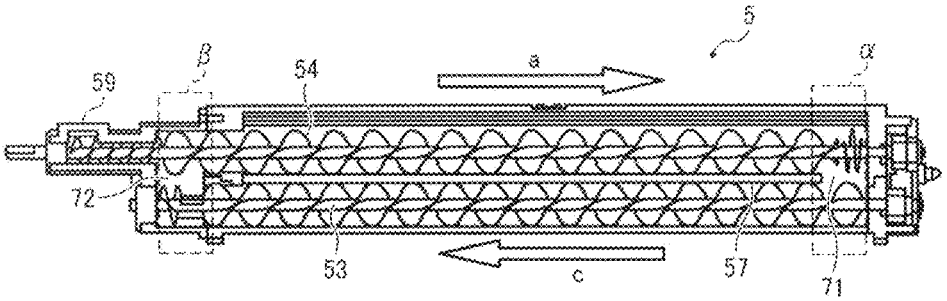
FIG. 5C is a cross-sectional view of the developing device shown in FIG. 5B.

FIG. 4 is a perspective view illustrating the developing device 5 from which the development cover 58*c* is removed. FIG. 5A is a top view of the developing device 5 from which the development cover 58*c* is removed, FIG. 5B is a side view of the developing device as viewed in the direction indicated by arrow A shown in FIG. 4. FIG. 5C is a cross-sectional view of the developing device 5 as viewed in the direction indicated by arrow A shown in FIG. 4.

The developing device 5 includes the developing roller 50 serving as a developer bearer disposed facing the photoreceptor 1, a supply screw 53, a collecting screw 54, a doctor blade 52 serving as a developer regulator, and a partition 57. The supply screw 53 and the collecting screw 54 may be screw members each including a rotary shaft and a spiral blade winding around the rotary shaft and transport developer in an axial direction by rotating.

The casing 58 includes a development opening 58e to partly expose the surface of the developing roller 50 in a development range where the developing roller 50 faces the photoreceptor 1.

The doctor blade 52 is disposed facing the surface of the developing roller 50 and adjusts the amount of developer carried on the surface of the developing roller 50.

The supply screw 53 and the collecting screw 54A serve as multiple developer conveyance members to agitate and transport developer in the longitudinal direction, thereby establishing a circulation channel. The supply screw 53 faces the developing roller 50 and supplies developer to the developing roller 50 while transporting the developer in the longitudinal direction. The collecting screw 54 transports developer while mixing the developer with supplied toner.

The partition 57 divides, at least partly, an interior of the casing 58 into a supply channel 53*a* in which the supply screw 53 is provided and a collecting channel 54*a* in which the collecting screw 54 is provided. Additionally, on the cross section (shown in FIG. 1A) perpendicular to the axial direction, an end face of the partition 57 faces the developing roller 50 and positioned adjacent to the developing roller 50. Thus, the partition 57 can also serve as a separator to facilitate separation of developer from the surface of the developing roller 50. The partition 57 having the separating capability can inhibit the developer that has passed through the development range, carried on the developing roller 50, from reaching the supply channel 53*a*. Thus, the developer is not retained but can move to the collecting channel 54*a*.

As shown in FIGS. 1A and 1B, the developing roller 50 includes a magnet roller 55 including multiple stationary magnets and a developing sleeve 51 that rotates around the magnet roller 55. The developing sleeve 51 is a rotatable, cylindrical member constructed of a nonmagnetic material. The magnet roller 55 is housed inside the developing sleeve 51. The magnet roller 55 generates, for example, five magnetic poles, first through fifth poles P1 through P5. The first and third poles P1 and P3 are south (S) poles, and the second, fourth, and fifth poles P2, P4, and P5 are north (N) poles, for example. As the developing sleeve 51 rotates around the magnet roller 55 in which the multiple magnetic poles are formed, developer moves in the circumferential direction (in the direction of arc) of the developing roller 50.

It is to be noted that bold petal-like lines with reference characters P1 through P5 in FIG. 1A represent density distribution (in absolute value) of magnetic flux generated by the respective magnetic poles on the developing sleeve 51 in a direction normal to the surface of the developing sleeve 51.

The developing device 5 contains two-component developer consisting essentially of toner and carrier (one or more additives may be included) in a space (e.g., the supply channel 53*a* and the collecting channel 54*a*) defined by the casing 58. The supply screw 53 and the collecting screw 54 transport developer in the longitudinal direction (an axial direction of the developing sleeve 51), and thus a developer circulation path is established inside the developing device 5. Additionally, the supply screw 53 and the collecting screw 54 are arranged vertically, and the supply channel 53*a* and the collecting channel 54*a* are divided from each other with the partition 57 disposed between the two developer conveyance members. The developing device 5 further includes a toner density detector to detect the density of toner included in developer contained in the supply channel 53*a* or the collecting channel 54*a*.

In the configuration shown in FIG. 1A, the doctor blade 52 is provided beneath the developing roller 50 and upstream in the direction of rotation of the developing sleeve 51 from the development range where the developing roller 50 faces the photoreceptor 1. The doctor blade 52 adjusts the amount of developer conveyed to the development range, carried on the developing sleeve 51.

Further, a toner supply inlet 59 is in the developing device 5 to supply toner to the developing device 5 in response to consumption of toner because two-component developer is used in the present embodiment. While being transported, the supplied toner is agitated and mixed with the developer exiting in the developing device 5 by the collecting screw 54 and the supply screw 53. The developer thus agitated is partly supplied to the surface of the developing sleeve 51 serving as the developer bearer and carried thereon. After the doctor blade 52 disposed beneath the developing sleeve 51 adjusts the amount of developer carried on the developing sleeve 51, the developer is transported to the development range. In the development range, the toner in developer on the developing sleeve 51 adheres to the latent image on the surface of the photoreceptor 1.

In the developing device 5 according to the present embodiment, a constant or substantially constant amount of developer is contained. For example, in the developer usable in the present embodiment, toner particles, including polyester resin as a main ingredient, and magnetic carrier particles, are mixed uniformly so that the density of toner is about 7% by weight. The toner has an average particle diameter of about 5.8 μm, and the magnetic carrier has an average particle diameter of about 35 μm, for example. The supply screw 53 and the collecting screw 54 arranged in parallel are rotated at a velocity of about 600 to 800 revolutions per minute (rpm), thereby transporting developer while mixing toner and carrier, charging the toner. Additionally, the toner supplied through the toner supply inlet 59 is agitated in the developer by rotating the supply screw 53 and the collecting screw 54 to make the content of toner in the developer uniform.

While being transported in the longitudinal direction by the supply screw 53 positioned adjacent to and parallel to the developing sleeve 51, the developer in which toner and carrier are mixed uniformly is attracted by the fifth pole P5 of the magnet roller 55 inside the developing sleeve 51 and carried on the outer circumferential face of the developing sleeve 51. The developer carried on the developing sleeve 51 is transported to the development range as the developing sleeve 51 rotates counterclockwise as indicated by arrow Y shown in FIG. 1A.

The developing sleeve 51 receives voltage from a power source 151, and thus a development field (electrical field) is generated between the developing sleeve 51 and the photoreceptor 1 in the development range. With the development field, the toner in developer carried on the surface of the developing sleeve 51 is supplied to the latent image on the surface of the photoreceptor 1, developing it.

The developer on the developing sleeve 51 that has passed through the development range is collected in the collecting channel 54*a* as the developing sleeve 51 rotates. Specifically, developer falls from the developing sleeve 51 to an upper face of the partition 57, slides down the partition 57, and then is collected by the collecting screw 54.

Inside the developing device 5, developer flows as indicated by arrows shown in FIGS. 5A and 5C. Specifically, arrow a indicates the flow of developer (i.e., a developer conveyance direction) transported in the collecting channel 54*a* by the collecting screw 54. Arrow b shown in FIG. 5A indicates the flow of developer carried onto the developing sleeve 51 and transported to the collecting channel 54*a*, and arrow c in the FIG. 5C indicates the flow of developer transported inside the supply channel 53*a* by the supply screw 53.

The collecting channel 54*a* on the upper side and the supply channel 53*a* on the lower side in FIG. 5C communicate with each other in end areas α and β that are end areas in the axial direction of the supply screw 53 and the collecting screw 54. The end area a is on the downstream side in the direction indicated by arrow a in which the collecting screw 54 transports developer, and the end area β is on the downstream side in the direction indicated by arrow c in which the supply screw 53 transports developer. Developer is transported down from the collecting channel 54*a* to the supply channel 53*a* in the end area a and transported up from the supply channel 53*a* to the collecting channel 54*a* in the end area β.

In the end areas α and β, which are communicating portions, the supply screw 53 and the collecting screw 54 are varied in shape to exert a capability to transport developer in a direction perpendicular to the conveyance directions indicated by arrows a and c. For example, a paddle or a reversed spiral blade can be provided to portions of these screws facing the end areas α and β.

FIG. 6 is a schematic diagram illustrating movement of developer and an accumulation state of developer in the longitudinal direction (axial direction) inside the developing device 5. In FIG. 6, outlined arrows a and c indicate the flow of developer in the developing device 5. Although the partition 57 is omitted in FIG. 6 for simplicity, as shown in FIG. 5C, openings (a developer-falling opening 71 and a developer-lifting opening 72) are in end portions of the partition 57 in the longitudinal direction of the developing device 5. With these openings, the end areas α and β as the communication portions are secured between the supply channel 53*a* and the collecting channel 54*a*.

As shown in FIG. 6, at the downstream end of the supply channel 53*a* in the direction in which developer is transported by the supply screw 53, developer is transported up, as indicated by arrow d, through the developer-lifting opening 72 in the partition 57 to the upstream end of the collecting channel 54*a* in the developer conveyance direction therein. The developer that has reached a downstream end portion of the collecting channel 54*a* in the developer conveyance direction by the collecting screw 54 is transported through the developer-falling opening 71 in the partition 57 as indicated by arrow e to the upstream end portion of the supply channel 53*a* in the developer conveyance direction therein.

It is to be noted that, although the supply channel 53*a* and the collecting channel 54*a* are illustrated as if they are away from each other in FIG. 6, it is intended for ease of understanding of supply and collection of developer from the developing sleeve 51. The supply channel 53*a* and the collecting channel 54*a* are separated by the planar partition 57 as shown in FIGS. 1A and 5C, and the developer-falling opening 71 and the developer-lifting opening 72 are through holes in the partition 57.

As shown in FIG. 6, the developer inside the supply channel 53*a* beneath the collecting channel 54*a* is scooped onto the surface of the developing sleeve 51 while being transported in the longitudinal direction by the supply screw 53. At that time, developer can be scooped onto the surface of the developing sleeve 51 by the rotation of the supply screw 53 as well as the magnetic force exerted by the fifth pole P5, serving as a developer scooping pole. Then, the developer carried on the developing sleeve 51 is transported through the development range, separated from the developing sleeve 51, and transported to the collecting channel 54*a*. At that time, developer is separated from the surface of the developing sleeve 51 by the magnetic force exerted by a developer release pole constructed of the fourth and fifth magnetic poles P4 and P5 having the same polarity (N) and being adjacent to each other and the separating capability of the partition 57.

In the developing device 5, the fourth and fifth poles P4 and P5 (i.e., the developer release pole) generate a repulsive magnetic force. In the area in which the repulsive magnetic force is generated (i.e., a developer release area), developer is released by the developer release pole in a direction of composite of a normal direction and a direction tangential to the rotation of the developing sleeve 51. Then, the developer falls under the gravity to the partition 57 and is collected by the collecting screw 54.

The collecting screw 54 in the collecting channel 54*a*, which is above the supply channel 53*a*, transports the developer separated from the developing sleeve 51 in the developer release area axially in the direction opposite the direction in which the supply screw 53 transports developer.

Through the developer-lifting opening 72, the downstream end of the supply channel 53*a* in which the supply screw 53 is provided communicates with the upstream end of the collecting channel 54*a* in which the collecting screw 54 is provided. The developer at the downstream end of the supply channel 53*a* accumulates there and pushed up by the developer transported from behind. Then, the developer moves through the developer-lifting opening 72 to the upstream end of the collecting channel 54*a*.

The toner supply inlet 59 is in the upstream end portion of the collecting channel 54*a*, and fresh toner is supplied as required by a toner replenishing device from the toner container 11 (shown in FIG. 2) to the developing device 5 through the toner supply inlet 59. The upstream end of the supply channel 53*a* communicates with the downstream end of the collecting channel 54*a* via the developer-falling opening 71. The developer transported to the downstream end of the collecting channel 54*a* falls under its own weight through the developer-falling opening 71 to the upstream end portion of the supply channel 53*a*.

As described above, the supply screw 53 and the collecting screw 54 rotate in the directions indicated by arrows shown in FIG. 1A, and developer is attracted to the developing sleeve 51 by the magnetic attraction exerted by the magnet roller 55 contained in the developing sleeve 51. Additionally, the developing sleeve 51 is rotated at a predetermined velocity ratio to the velocity of the photoreceptor 1 to scoop up the developer to the development range consecutively.

In the developing device 5, while the supply screw 53 agitates and transports developer in the supply channel 53*a*, the developer is supplied onto the developing sleeve 51, and the developer on the developing sleeve 51 is collected in the collecting screw 54. Accordingly, the amount of developer transported in the supply channel 53*a* decreases toward downstream in the developer conveyance direction by the supply screw 53, and the surface of developer accumulating inside the supply channel 53*a* is oblique as shown in FIG. 6.

Assuming that Wm represents a developer conveyance capability of the supply screw 53, which can be obtained from the diameter and the pitch of the blade of the supply screw 53 and the frequency of rotation of the supply screw 53, and Ws represents a developer conveyance capability on the developing sleeve 51, developer can be uniformly transported on the surface of the developing sleeve 51 when Wm>Ws. If this relation is not satisfied, it is possible that the amount of developer becomes insufficient on the downstream side of the supply channel 53*a* in the conveyance direction of the supply screw 53, and developer is not supplied to the developing sleeve 51 on the downstream side. Accordingly, the supply screw 53 is to have a developer conveyance capability (Wm) greater than the amount of developer transported on the developing sleeve 51.

Additionally, when developer is collected from the developing sleeve 51 into the collecting channel 54*a*, if the bulk of the developer in the collecting channel 54*a* is excessively large and the level is high, it is possible that developer is not collected in the collecting channel 54*a* but moves through a clearance between the partition 57 and the developing sleeve 51 to the supply channel 53*a*. Then, the developer can be supplied to the development range before agitated sufficiently by the supply screw 53. When the insufficiently agitated developer reaches the development range, it causes substandard images. Accordingly, the collecting screw 54 is to have a developer conveyance capability greater than the amount of developer transported on the developing sleeve 51 as well.

Thus, it is preferred that the developer conveyance capabilities of the supply screw 53 and the collecting screw 54 be greater than the amount of developer transported on the developing sleeve 51. To achieve this, the rotational frequency of the supply screw 53 and the collecting screw 54 tend to be relatively high.

(First Embodiment)

A first embodiment of the developing device 5 is described below.

As shown in FIG. 1B, in the developing device 5 according to the first embodiment, the developing sleeve 51 includes a base pipe 51*a* that is a base to secure a cylindrical shape and a low friction film 51*b*. For example, the base pipe 51*a* includes aluminum or can be made of aluminum. The low friction film 51*b* is a surface layer (i.e., a low friction surface layer) and lower in friction coefficient with toner than the base pipe 51*a*. As shown in FIG. 1A, the developing device 5 according to the first embodiment is further provided with the power source 151, serving as a voltage application device, to apply superimposed voltage to the base pipe 51*a* of the developing sleeve 51. Specifically, the superimposed voltage in which an alternating voltage component (AC component) is superimposed on a direct voltage component (DC component) is applied to the base pipe 51*a*. When aluminum is used for the base pipe 51*a*, the developing sleeve 51 can be non-magnetic and conductive.

Herein, in electrophotographic image forming apparatuses, typically a laser beam is directed to a uniformly charged surface of a photoreceptor according to image data, thereby forming an electrostatic latent image. Then, toner included in developer carried on a developing roller of a developing device is supplied to the electrostatic latent image, and a toner image is formed on the photoreceptor. The toner image is then transferred by a transfer member onto a recording medium and fixed thereon by a fixing device.

A developing bias applied to the developing roller is typically either a DC bias constructed of a DC component or a superimposed bias in which an AC component is superimposed on a DC component.

Additionally, there are two development types: one-component development employing one-component developer consisting essentially of toner and two-component development employing two-component developer including toner and carrier. In high speed image forming apparatuses, two-component development is mainly used to secure a durability thereof. In high speed image forming apparatuses, there are demands for high image quality to cope with commercial printing.

Further, in addition to one-component development and two-component development, hybrid development is proposed. In any of the development types, to attain full-color images that excel in color reproducibility, uniformity, and sharpness, it is preferred to make the amount of toner supplied to the latent image bearer, such as the photoreceptor, conform to the electrostatic latent image.

Next, descriptions are given below of ghost images caused by fluctuations in the amount of toner adhering to the latent image bearer.

It is known that fluctuations in the amount of toner adhering to the latent image bearer are caused by, in addition to fluctuations in the amount of toner change, an inheritance of image history from a preceding image to a subsequent image.

In hybrid development, the amount of toner on a toner bearer changes in accordance with a toner consumption pattern of an immediately preceding image, and the image density of a subsequent image tends to fluctuate. This is caused because the amount of toner supplied to the toner bearer is kept identical or similar constantly in hybrid development, the amount of toner on the toner bearer varies depending on the number of times toner is supplied to the toner bearer. That is, in a case in which the toner consumption amount of the preceding image is small, the amount of toner remaining on the toner bearer is greater. The amount of toner on the toner bearer further increases after toner is supplied thereto, resulting in increases in image density. By contrast, after an image that consumes a greater amount of toner is printed, a smaller amount of toner remains on the toner bearer. It is possible that the amount of toner on the toner bearer is small even after toner is supplied thereto, resulting in decreases in image density.

By contrast, even in two-component developing devices, like the developing device 5 according to the first embodiment, it is possible that the subsequent image inherits the history of the preceding image and the image density becomes uneven, resulting in a ghost image.

The inventors of the present invention recognize that ghost images in two-component developing devices are caused as follows.

As described above, the repulsive magnetic force to separate carrier particles from the developing sleeve acts on the surface of the developing sleeve that has passed through the development range. At that time, it is possible that a part of toner included in two-component developer does not leave the surface of the developing sleeve together with the carrier moving away therefrom, and the toner thus remaining on the developing sleeve makes the developing sleeve smeary.

Regarding the smear on the developing sleeve, toner is liable to adhere more to a portion that has faced a non-image area on the photoreceptor when the surface of the developing sleeve passes through the development range than a portion that has faced an image area on the photoreceptor. Thus, susceptibility of toner to adhere to the developing sleeve differs depending on whether that portion has faced the non-image area or the image area. That is, the development amount in the subsequent image depends on which of the non-image area and the image area the surface of the developing sleeve has faced in the preceding image. This can be a cause of a ghost image in the subsequent image.

Initially, descriptions are given below of the susceptibility of toner to adhere to the portion that has faced the non-image area.

The electrostatic latent image is formed on the latent image bearer by differences in electrical potential between the exposed portion and the non-image portion that is not exposed after the surface of the latent image bearer is charged uniformly. Potential of the image area, to which toner is supplied, is stronger in attracting charged toner than potential of the developing sleeve. By contrast, potential of the non-image area, to which toner is not supplied, is stronger in keeping away charged toner than the potential of the developing sleeve.

Accordingly, when the surface of the developing sleeve faces the non-image area of the photoreceptor in the development range during the development of the preceding image, force heading from the photoreceptor toward the surface of the developing sleeve is exerted on the charged toner due to differences in electrical potential between the non-image area and the developing sleeve. Then, the toner included in developer borne on the developing sleeve moves to the developing sleeve, in particular, to a root side of the magnetic brush on the developing sleeve, that is, the surface of the developing sleeve.

At that time, a part of toner contacts the surface of the developing sleeve and adheres thereto, and the chance of toner to contact the surface of the developing sleeve increases since toner moves to the root side of the magnetic brush. Accordingly, the amount of toner that adheres to that portion of the developing sleeve increases. Accordingly, on the portion that has faced the non-image area in the preceding image formation, the potential shifts more in the direction of the toner normal polarity.

Next, descriptions are given below of the occurrence of ghost image in subsequent image formation resulting from the susceptibility of toner to adhere to the portion that has faced the non-image area.

On the surface of the developing sleeve downstream from the development range in the direction in which the developing sleeve rotates, the magnetic field generator exerts magnetic force to separate carrier particles from the developing sleeve.

The toner that contacts the developing sleeve is in contact with carrier either directly or via another toner particle. When the carrier leaves the surface of the developing sleeve, although the toner adhering to the carrier generally moves away together with the carrier, the toner adhering to both the carrier and the surface of the developing sleeve remains on one of them that is greater in adhesion force with toner. Accordingly, in a case where the adhesion force of toner to the developing sleeve is greater, when the carrier moves away from the developing sleeve due to the repulsive magnetic force, the toner adhering to the surface of the developing sleeve does not move away together with the carrier but remains on the developing sleeve. Subsequently, when the surface of the developing sleeve reaches the developer supply position, two-component developer is supplied again to the surface of the developing sleeve on which toner remains.

In a state where the charged toner adheres thereto, the surface potential of the developing sleeve is increased by an amount equivalent to the electrical charge of the toner, and the surface potential is shifted to the side of toner charge polarity. Additionally, in the development range, on the surface of the photoreceptor carrying the latent image, toner adheres to an image area having an electrical potential shifted to the opposite polarity (in the present embodiment, positive) of the toner charge polarity from the electrical potential (i.e., a development potential) of the surface of the developing sleeve. Therefore, when the developing sleeve is supplied again with two-component developer and then faces the image area in the development range, the surface of the developing sleeve on which the charged toner remains has stronger force to move toner to the image area of the photoreceptor than the surface on which no toner remains. This increases the amount of toner supplied to the image area of the photoreceptor.

By contrast, in a case of the surface of the developing sleeve, carrying two-component developer, that faces the image area of the photoreceptor in the development range in developing the preceding image, the toner included in developer carried on the developing sleeve moves away from the developing sleeve due to differences in electrical potential between the image area and the developing sleeve. That is, the toner moves to a tip side of the magnetic brush. In the development range, a part of the toner included in two-component developer moves to the image area, that is, the electrostatic latent image, and develops it into a toner image. At that time, although some of the toner may remain unused in developing the electrostatic latent image, such toner rarely contacts and adheres to the developing sleeve since the toner is on the tip side of the magnetic brush in the development range. When the carrier moves away from the developing sleeve due to the repulsive magnetic force, most of the toner included in two-component developer carried on the developing sleeve moves away from the developing sleeve together with the carrier. Then, almost no toner remains on the surface of the developing sleeve.

Subsequently, when the surface of the developing sleeve reaches the developer supply position, two-component developer is supplied to the surface of the developing sleeve on which almost no toner remains. The electrical potential of the surface of the developing sleeve to which almost no charged toner adheres is not shifted to the side of the toner charge polarity. When the developing sleeve is supplied again with two-component developer and then faces the image area in the development range, the surface of the developing sleeve has weaker force to move toner to the image area than the surface on which toner remains.

Thus, the surface of the developing sleeve that has faced the non-image area in the preceding image exerts stronger force to move toner to the image area of the subsequent image than the surface of the developing sleeve that has faced the image area in the preceding image. Consequently, depending on which area (the non-image area or the image area) the surface of the developing sleeve has faced in the preceding image, the amount of toner that adheres to the image area in the subsequent image differs, and the image density fluctuates. It is conceivable that such image density fluctuations result in ghost images.

When toner contacts the developing sleeve, non-electrostatic adhesion force between toner and carrier, and that between toner and developing sleeve decrease. At that time, when a work function of toner is close to that of the developing sleeve, which of the two (the developing sleeve or carrier) the toner adheres is stochastically determined. Additionally, when the work function of the developing sleeve is greater than that of toner, negative electrical charges of toner that is in contact with the developing sleeve is transferred to the developing sleeve, which is a phenomenon called contact electrification. Accordingly, image force between toner and the developing sleeve becomes weaker, and toner does not leave carrier (or adheres again to carrier).

In developing a white solid image (i.e., a blank image), since the developing sleeve faces the non-image area of the photoreceptor in the development range, the developing sleeve is smeared with toner after developing the white solid image. Accordingly, the surface of the developing sleeve that has developed the white solid image tends to have a surface potential increased by an amount equivalent to the electrical charge of toner adhering to the developing sleeve and, when used in development, the amount of toner that adheres to the image area of the photoreceptor (hereinafter "development amount") increases, thereby increasing the image density.

By contrast, in developing a solid image (i.e., a black solid image), the development field that causes toner to move to the photoreceptor is generated in the development range. Then, during the development, toner having normal electrical charges, out of smear of toner adhering to the developing sleeve, moves toward the photoreceptor. Consequently, after developing the solid image, the developing sleeve is not smeared with toner.

When the solid image is continuously developed in this state, the smear of toner adhering to the developing sleeve is removed while the developing sleeve makes one revolution. Accordingly, after the formation of the solid image, the increase in the developing bias equivalent to the smear of toner on the developing sleeve is canceled, and the development amount returns to an ordinal amount (reduced from the state increased by the non-image area). The above-described processes arise in developing the black solid image following the development of the white solid image or in developing the black solid image immediately after an interval between sheets. Accordingly, the image density increases in a distance by which a leading end of the solid image goes round on the circumference of the developing sleeve.

A conceivable approach to inhibit ghost images is to provide a low friction surface layer constructed of, for example, tetrahedral amorphous carbon (ta-C) on the surface of the developing sleeve.

The low friction surface layer on the developing sleeve can reduce the friction coefficient thereof with toner and accordingly make the adhesion force between toner and carrier greater than that between toner and the developing sleeve when the carrier is separated from the developing sleeve by the repulsive magnetic force. This can help toner to leave the developing sleeve together with carrier even if the toner moves to and contacts the surface of the developing sleeve due to the difference in potential between the non-image area and the developing sleeve. This is effective in inhibiting smear with toner of the portion of the developing sleeve that has faced the non-image area in the preceding image formation and reducing the possibility that new developer is supplied to the smeary portion. This can inhibit differences in the amount of toner adhering to the developing sleeve depending on whether that portion has faced the non-image area or the image area.

Thus, the low friction film can inhibit toner from remaining on the developing sleeve, thereby inhibiting the occurrence of ghost images caused by the difference in the amount of toner adhering.

In the developing device 5 according to the first embodiment, since the surface of the developing sleeve 51 is coated with the low friction film 51*b*, the occurrence of ghost images can be suppressed. However, it may be difficult to make the thickness of the low friction film 51*b* uniform, and it is possible that the low friction film 51*b* has unevenness in thickness.

The inventors of the present invention have found that unevenness in thickness of the low friction surface layer can cause cyclic image density unevenness as follows.

Figure 7A:
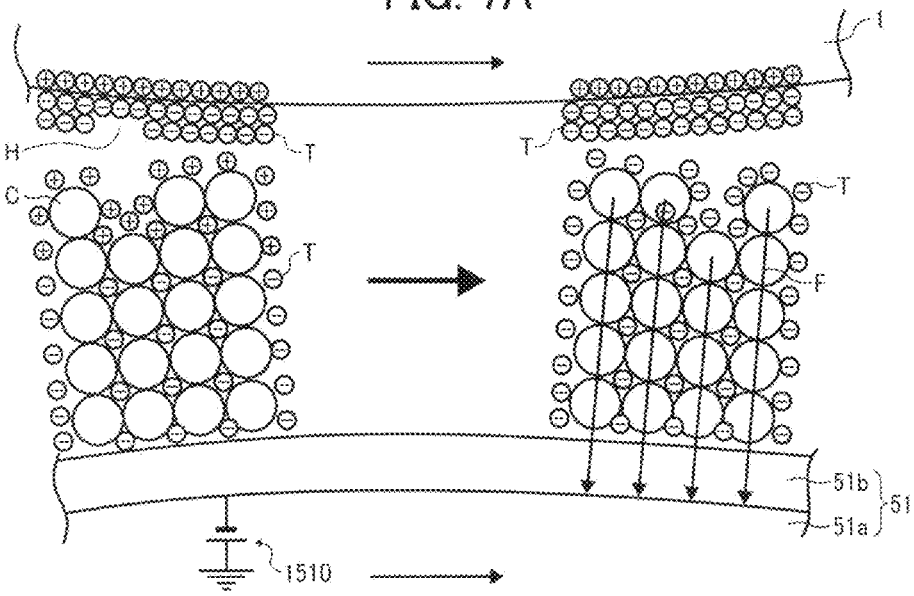
FIG. 7A is a schematic view illustrating a development range and an adjacent area in a configuration in which a low friction film is thinner.
Figure 7B:
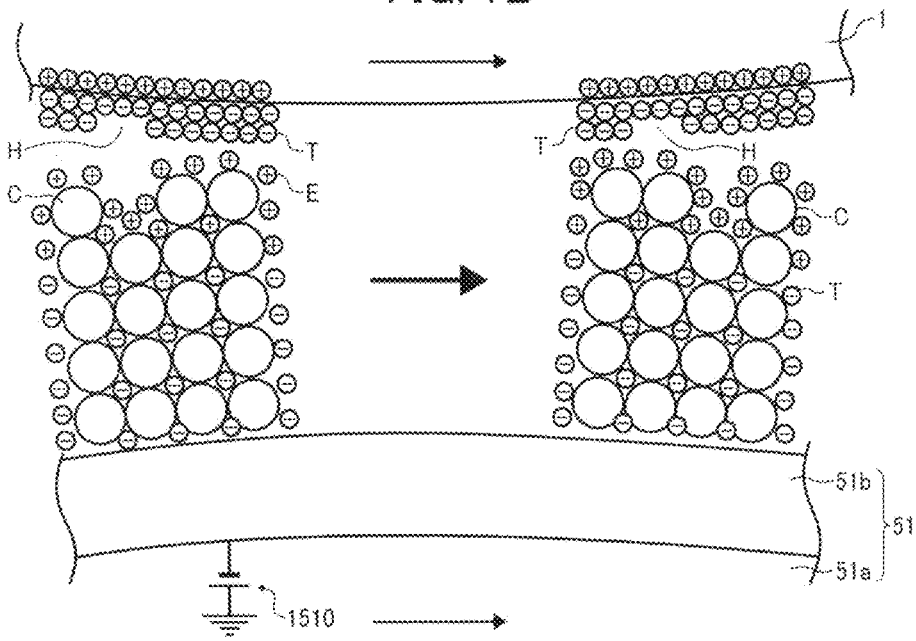
FIG. 7B is a schematic view illustrating a development range and an adjacent area in a configuration in which a low friction film is thicker.

FIGS. 7A and 7B are schematic view illustrating development ranges and adjacent areas for understanding of a presumed mechanism how density unevenness is caused by the thickness unevenness of the low friction film 51*b*. FIG. 7A illustrates a configuration in which the low friction film 51*b* is thinner, and FIG. 7B illustrates a configuration in which the low friction film 51*b* is thicker.

FIGS. 7A and 7B are schematic view illustrating development ranges and adjacent areas for understanding of a presumed mechanism how density unevenness is caused by the thickness unevenness of the low friction film 51*b*. FIG. 7A illustrates a configuration in which the low friction film 51*b* is thinner, and FIG. 7B illustrates a configuration in which the low friction film 51*b* is thicker.

In FIGS. 7A and 7B, the photoreceptor 1 and the developing sleeve 51 move from the left to the right, reference character C represents carrier particles, and reference character T represents toner particles. As shown in FIGS. 7A and 7B, on the surface of the developing sleeve 51 adjacent to the development range, the carrier particles C in two-component developer are in the form of the magnetic brush, and the toner particles T adhere to the magnetic brush. In FIGS. 7A and 7B, symbols "–" and "+" in the toner particles T mean that the toner particles have the negative polarity charges (hereinafter simply "negative charges") and have positive polarity charges (hereinafter simply "positive charges"), respectively. Additionally, in the configurations shown in FIGS. 7A and 7B, a power source 1510 applies, as a developing bias, not the superimposed voltage but the DC component only to the base pipe 51*a*.

In FIGS. 7A and 7B, although clearance is present between the magnetic brush on the upstream side (on the left in these drawings) and the magnetic brush on the downstream side (on the right in these drawings) in the direction in which the developing sleeve 51 rotates, the magnetic brush in practice extends entirely in the developing sleeve 51 adjacent to the development range, and no clearance is present between the upstream side and the downstream side.

In the configurations shown in FIGS. 7A and 7B, the image area on the surface of the photoreceptor 1 is charged to the positive polarity, and a part of the toner particles T adhering to the magnetic brush moves and adheres to the surface of the photoreceptor 1 due to differences in potential with the developing sleeve 51. At that time, since the negatively charged toner particles T leave the magnetic brush, as in the magnetic brushes on the left in FIGS. 7A and 7B, the positive charges equivalent to counter charges remain on the magnetic brush.

In two-component development typically used, when the amount of charge of the image area (an exposed portion) on the photoreceptor 1 is balanced (in equilibrium) with the amount of charge on the side of the developing sleeve 51 including the counter charges remaining on the magnetic brush, the toner particles T stop moving, and development completes.

However, development can be still feasible if the positive charges equivalent to the counter charges are transferred toward the base pipe 51*a* as indicated by arrow F shown in FIG. 7A.

The low friction film 51*b* constructed of tetrahedral amorphous carbon or the like has an electrical resistance greater than that of the base pipe 51*a* constructed of metal such as aluminum. Accordingly, as the low friction film 51*b* becomes thinner, it is easier for the positive charges to move toward the base pipe 51*a*.

Reference character H in FIGS. 7A and 7B represents portions where the amount of toner particles T adhering thereto does not yet reach a predetermined amount although the potential of the image area is capable of attracting more toner particles T. Such portions H where the amount of toner particles T is insufficient result in light density portions, in which the image density is lighter than in other image areas.

As in the configuration shown in FIG. 7A, when the low friction film 51*b* is thinner, the positive charges equivalent to the counter charges can move to the base pipe 51*a*. Accordingly, as in the magnetic brush on the left in FIG. 7A, even when the charge amount is temporarily balanced, development can be still feasible for an amount of the positive charges that move to the base pipe 51*a*, out of the positive charges equivalent to the counter charges. Then, the image area, such as the portion H in FIG. 7A, where the amount of toner particles T adhering thereto is insufficient, can be filled with the toner particles T. It can inhibit generation of the light density portions where the image density is lighter than other portions.

As an example of the thinner low friction film 51*b*, when a tetrahedral amorphous carbon (ta-C) layer of about 0.1 μm is used, it takes about 0.7 msec (i.e., a transit time) for the positive charges equivalent to the counter charges to move to the base pipe 51*a*. This transit time (about 0.7 msec in this example) is not greater than a period of time for a given position on the surface of the developing sleeve 51 to pass through the development range (i.e., a developing nip), which is about 7 msec. Accordingly, while the given position of the developing sleeve 51 passes through the development range, the positive charges equivalent to the counter charges can be transferred to the base pipe 51*a*, and development becomes feasible for the time equivalent to the positive charges thus transferred. Then, the image area where the amount of the toner particles T adhering thereto is insufficient can be filled with the toner particles T, thus inhibiting generation of the light density portions.

By contrast, as in the configuration shown in FIG. 7B, when the low friction film 51*b* is thicker, the positive charges equivalent to the counter charges rarely move to the base pipe 51*a*. Accordingly, as in the magnetic brush on the left in FIG. 7B, when the charge amount is balanced, the positive charges equivalent to the counter charges rarely move to the base pipe 51*a*, and thus development is not feasible. Then, when the charge amount is balanced, the image area, such as the portion H in FIG. 7B, where the amount of toner particles T adhering thereto is insufficient, is kept as is, thus generating the light density portions.

As an example of the thicker low friction film 51*b*, when a ta-C layer of about 0.6 μm is used, it takes about 70 sec for the positive charges equivalent to the counter charges to move to the base pipe 51*a*. This transit time (about 70 sec in this example) is greater than a period of time for a given position on the surface of the developing sleeve 51 to pass through the development range (i.e., the developing nip), which is about 7 msec. Accordingly, the transfer of the positive charges equivalent to the counter charges to the base pipe 51*a* does not complete while the given position of the developing sleeve 51 passes through the development range, and the portion H where the amount of the toner particles T adhering thereto is insufficient results in the light density portion.

As explained above with reference to FIGS. 7A and 7B, a portion where the low friction film 51*b* is thinner is less likely to cause the light density portion, and a portion where the low friction film 51*b* is thicker is likely to cause the light density portion. Since the portion of the thicker low friction film 51*b* reduce the image density, cyclic density unevenness corresponding to the unevenness in the layer thickness is caused.

It is to be noted that the development gap, which is a clearance between the developing sleeve 51 and the photoreceptor 1, may be caused to fluctuate by the unevenness in the layer thickness of the low friction film 51*b* that is the surface layer of the developing sleeve 51. However, in the developing device 5 according to the first embodiment, the low friction film 51*b* is a deposition layer in nano order, and the unevenness in the layer thickness is about one tenth of several micrometers (μm). Since the development gap is about 0.2 mm (=200 μm), it can be deemed that fluctuations in the development gap resulting from the unevenness in the layer thickness rarely affect the image density unevenness.

In the configuration shown in FIGS. 7A and 7B in which the developing bias include the DC component only (i.e., DC bias development), saturation development is difficult.

The term "saturation development" used here means a state in which the development field generated by the potential difference between the electrostatic latent image on the latent image bearer (i.e., the photoreceptor 1) and the opposed electrode (i.e., the developing sleeve 51) is canceled by the toner electrical field, and thus the development field has no potential (0). In other words, it means a state in which the amount of toner adhering to the electrostatic latent image on the photoreceptor 1 is sufficient and no more toner adheres thereto by the force of electrical field.

If saturation development is difficult, there is a risk that the amount of toner adhering to the electrostatic latent image fluctuates due to changes in the development gap between the photoreceptor 1 and the developing sleeve 51, and the image density is likely to fluctuate.

The inventors of the present invention have found that development can be closer to saturation development in configurations in which the developing bias includes the AC component or the DC component superimposed with the AC component (hereinafter "AC bias development").

According to experiments to visualize development phenomena and considerations by the inventors, it is conceivable that the followings contribute to development closer to saturation development.

In two-component development, the carrier particles included in two-component developer carried on the developing sleeve stand on end and form the magnetic brush in the development range. Then, the carrier particles near the end of the magnetic blush contact the surface of the photoreceptor. In DC bias development, toner particles that contribute to development are only those adhering to the carrier particles that contact the electrostatic latent image on the photoreceptor. In other words, toner particles that are contactless with the surface of the photoreceptor do not contribute to development.

By contrast, in AC bias development, the toner particles that contribute to development are not only those adhering to the carrier particles that contact the electrostatic latent image. The toner particles in an intermediate portion of the magnetic brush also leave the carrier particles due to the AC electrical field and contribute to development. Thus, in AC bias development, other toner particles than those in contact with the electrostatic latent image can be supplied to the electrostatic latent image. Accordingly, the developability, which is the amount of toner that contributes to development, is greater, and development closer to saturation development is feasible.

Additionally, the inventors of the present invention have found that, even in the configuration in which the low friction film 51*b* is provided on the developing sleeve 51, the cyclic image density unevenness corresponding to the thickness unevenness of the low friction film 51*b* can be suppressed using AC bias development, owing to the followings.

In DC bias development, if saturation development is not attained in the portion where the low friction film 51*b* is thinner, in the portion where the low friction film 51*b* is thicker and the developability is reduced, the amount of toner adhering to the image area decreases by an amount corresponding to the reduction in developability. Thus, the image density decreases. By contrast, if saturation development or close thereto is attained in the portion where the low friction film 51*b* is thinner owing to AC bias development, saturation development or close thereto can be maintained even in the portion where the low friction film 51*b* is thicker and the developability is reduced. Thus, decreases in image density can be suppressed. Further, even if the developability is reduced to a degree incapable of maintaining saturation development, the decrease in the amount of toner adhering can be made smaller than the reduction in developability, and decreases in image density can be suppressed.

Thus, the cyclic image density unevenness corresponding to the thickness unevenness of the low friction film 51*b* can be suppressed since decreases in image density in the portion where the low friction film 51*b* is thicker can be suppressed.

In the developing device 5 according to the first embodiment, since the developing sleeve 51 is provided with the low friction film 51*b* lower in friction coefficient with toner than the base pipe 51*a* constructed of, for example, aluminum as shown in FIG. 1B, the occurrence of ghost images caused by smear on sleeve can be suppressed. Additionally, as shown in FIG. 1A, development close to saturation development can be attained by applying the voltage in which the DC component is superimposed with the AC component. Accordingly, even if development conditions fluctuate to a certain degree due to fluctuations in thickness of the low friction film 51*b*, fluctuations in image density can be suppressed. Therefore, while inhibiting the occurrence of ghost images, image density unevenness resulting from fluctuations in thickness of the low friction film 51*b* can be suppressed.

By the way, to balance improvement of dot reproducibility and reduction of fog, an alternating voltage may be applied to the developing sleeve such that a first peak-to-peak voltage alternates with a second peak-to-peak voltage lower than the first peak-to-peak voltage.

EXPERIMENT 1

Next, descriptions are given below of experiment 1 executed to evaluate the occurrence of ghost images and image density unevenness in configuration 1 according to the first embodiment and comparative examples 1 through 3.

In experiment 1, a commercially available digital full-color copier, imagio MP C5000 from Ricoh Co., Ltd, was modified to install a developing device different in development conditions, and images produced thereby were evaluated. As the development conditions, relative to the developing device 5 shown in FIGS. 1A and 1B, the presence of the low friction film 51*b* and combination of applied voltage were different.

<Evaluation of Ghost Images>

Figure 8:
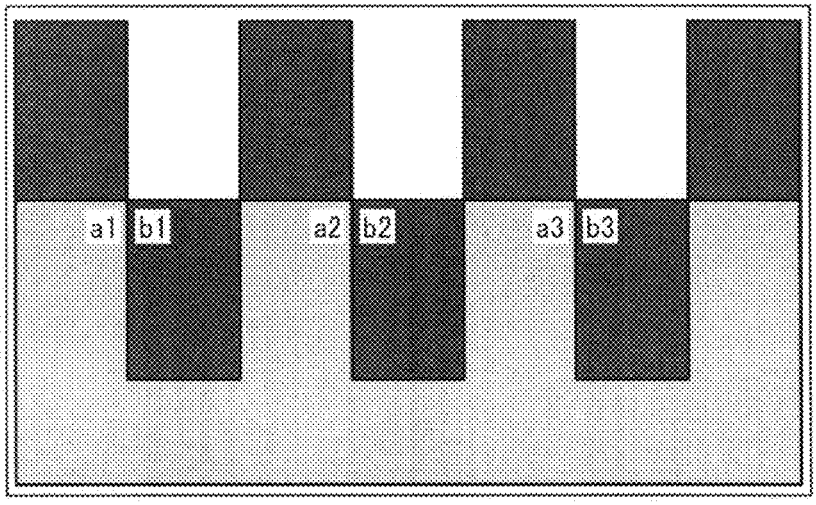
FIG. 8 is a conceptual diagram for understanding of occurrence of ghost images.

FIG. 8 is a conceptual diagram for understanding of occurrence of ghost images.

Regarding ghost images, after printing a chart having an image area ratio (also called "image coverage ratio") of 5% on 20 sheets (k sheets), an evaluation image for ghost image evaluation was printed. As the ghost image rating is based on differences in image density between an image (a) corresponding to a first revolution of the developing sleeve 51 and an image (b) corresponding to a subsequent revolution of the developing sleeve 51. Specifically, differences in image density between the image (a) and the image (b) were measured using an X-Rite densitometer (X-Rite 939), and a mean density difference ΔID of three positions (b1-a1, b2-a2, and b3-a3) was rated in the following four ratings of "excellent", "good", "acceptable", and "poor". The rating of "poor" is not acceptable and deemed failure.

Excellent: $\Delta ID \leq 0.01$,

Good: $0.01 < \Delta ID \leq 0.03$,

Acceptable: $0.03 < \Delta ID \leq 0.06$, and

Poor: $\Delta ID > 0.06$

According to the above-described evaluation method, ghost image evaluation was made.

<Image Density Unevenness Evaluation>

An A3-size single color (cyan) image having an image area ratio of 75% was printed, and lightness deviation (highest lightness—lowest lightness) within the image was measured using the X-Rite densitometer (X-Rite 939). As ratings of image density unevenness, the lightness deviation less than 2.0 was rated "good" (no problem), and the lightness deviation equal to or greater than 2.0 was results was rated "poor" (image density was uneven).

COMPARATIVE EXAMPLE 1

In comparative example 1, direct voltage was applied to an aluminum developing sleeve without the low friction film 51*b*.

Conditions of comparative example 1 are as follows.

Image forming apparatus: Modification of Ricoh imagio MP C5000;

Developer: Cyan;

Developing sleeve: Aluminum sleeve; and

Developing bias: Direct voltage

COMPARATIVE EXAMPLE 2

In comparative example 2, direct voltage was applied to an aluminum developing sleeve provided with a titanium nitride (TiN) coating as the low friction film 51*b*.

Conditions of comparative example 2 are as follows.

Image forming apparatus: Modification of Ricoh imagio MP C5000;

Developer: Cyan;

Developing sleeve: Aluminum sleeve coated with TiN; and

Developing bias: Direct voltage

COMPARATIVE EXAMPLE 3

In comparative example 3, direct voltage was applied to the aluminum developing sleeve 51 provided with the low friction film 51*b* constructed of tetrahedral amorphous carbon (ta-C).

Conditions of comparative example 3 are as follows.

Image forming apparatus: Modification of Ricoh imagio MP C5000;

Developer: Cyan;

Developing sleeve: Aluminum sleeve coated with ta-C (0.6 μm with deviation of 0.3 μm); and Developing bias: Direct voltage (Configuration 1)

In configuration 1, the developing sleeve 51 included the aluminum base pipe 51*a* and the low friction film 51*b* of ta-C, and the voltage in which the DC component is superimposed with the AC component was applied to the developing sleeve 51.

Conditions of configuration 1 are as follows.

Image forming apparatus: Modification of Ricoh imagio MP C5000;

Developer: Cyan;

Developing sleeve: Aluminum sleeve coated with ta-C (0.6 μm with deviation of 0.3 μm); and Developing bias: DC component superimposed with AC component Frequency of AC component: 5 kHz;

Amplitude (peat to peak): 1000 V;

Duty ratio of AC component: 50%; and

DC component (offset) −230 V

The term "duty ratio" here means, regarding the developing bias including the AC component that fluctuate cyclically, a ratio of a positive side component in a single cycle. In other words, it is a ratio of time during which the developing bias is on the positive side from the DC component of −230 V in one cycle period of fluctuations in the developing bias.

Table 1 shows the results of experiment 1.

It is to be noted that, in the column of image density unevenness in table 1, parenthesize numerals represent lightness deviation.

TABLE 1

| | MATERIAL OF SLEEVE | LOW FRICTION FILM | FRICTION COEFFICIENT | DEVELOPING BIAS | GHOST IMAGE | IMAGE DENSITY UNEVENNESS |
|---|---|---|---|---|---|---|
| C1 | Aluminum | None | 0.5 | DC | Poor | Good (1.5) |
| C2 | Aluminum | TiN | 0.4 | DC | Good | Poor (2.3) |
| C3 | Aluminum | ta-C (6 μm) | 0.15 | DC | Good | Poor (2.5) |
| E1 | Aluminum | ta-C (6 μm) | 0.15 | DC + AC | Good | Good (1.4) |

According to the evaluation results of configuration 1 in table 1, both of ghost images and image density unevenness can be inhibited by providing the low friction film 51*b* on the developing sleeve 51 and applying the developing bias including the AC component to the developing sleeve 51. Therefore, in the first embodiment, the developing sleeve 51 is provided with, as the surface layer, the low friction film 51*b* whose friction coefficient with toner is lower than that of the material (for example, aluminum) of the base pipe 51*a*.

EXPERIMENT 2

Descriptions are given below of experiment 2 executed to confirm the relation between fluctuations in the low friction film 51*b* and fluctuations in image density under conditions of comparative example 2 and configuration 1 described above.

Figure 9A:
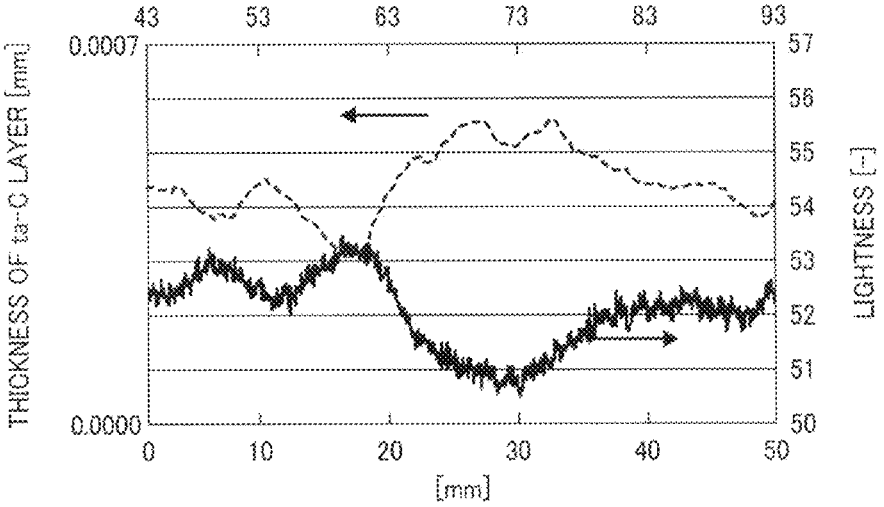
FIGS. 9A and 9B are graphs illustrating results of experiment 2.
Figure 9B:
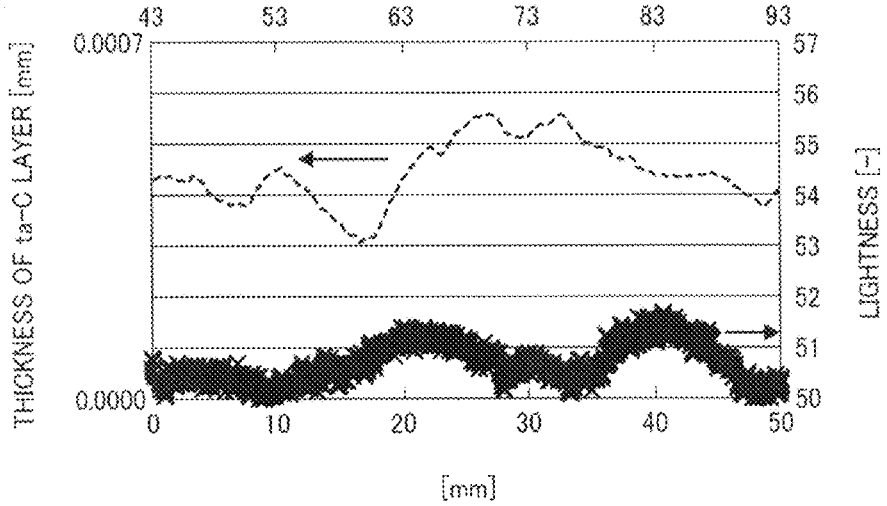

FIGS. 9A and 9B are graphs illustrating results of experiment 2. The graphs illustrate fluctuations in thickness of the low friction film 51*b* for one revolution of the developing sleeve 51 and fluctuations in lightness in the direction of transport of a sheet bearing an image formed using the developing sleeve 51. FIGS. 9A illustrates results of evaluation of comparative example 2, and FIG. 9B illustrates results of evaluation of configuration 1. In FIGS. 9A and 9B, broken lines represent the thickness of the low friction film 51*b*, and solid lines represent lightness of the image developed at the position corresponding to the thickness indicated by the broken lines. Fluctuations in lightness were measured on a halftone image (dot image) having an image area ratio of 75%.

The evaluation results of comparative example 2 shown in FIG. 9A show a correlation that lightness increases as the thickness of the low friction film 51*b* decreases. It is known, from the evaluation results of configuration 1 shown in FIG. 9B, that image density unevenness can be alleviated from that of comparative example 2 by applying the developing bias including the AC component (i.e., an AC developing bias).

This can be attained by the following reasons.

In the case of the developing bias including the DC component only (i.e., a DC developing bias), differences in thickness of the ta-C coating cause a portion (the low friction film 51*b* is thinner) where it is easy for the counter charges to escape and a portion (the low friction film 51*b* is thicker) where it is difficult. This is a conceivable reason why the thickness unevenness of the low friction film 51*b* makes the image density uneven.

By contrast, applying the AC developing bias can facilitate escape of the counter charges generated on the carrier, and development can be closer to saturation development than in DC bias development. Therefore, the thickness unevenness of the low friction film 51*b* is less likely to result in image density unevenness.

In the case of the AC developing bias, even when the resistance of developer or that of the developing roller is high, the electrical charges can easily move since a large electrical field is instantaneously acts thereon, compared with DC bias development. Thus, escape of the counter charges is facilitated. The following can be a cause why the AC developing bias can make development closer to saturation development. As described above with reference to FIGS. 7A and 7B, since the counter charges at the end of the magnetic brush escape, toner can easily go around to the end of the magnetic brush and be used in development.

To inhibit image density unevenness resulting from the thickness unevenness of the low friction film 51*b*, the thickness unevenness of the low friction film 51*b* itself may be reduced. However, in an approach to reduce the thickness unevenness of the low friction film 51*b* to a degree capable of sufficiently inhibiting image density unevenness, yields decrease and the cost increases. Thus, it is not desirable.

<Formation of the Low Friction Film 51*b*>

As shown in FIG. 1B, in the first embodiment, the developing sleeve 51 of the developing roller 50 is coated with the low friction film 51*b*.

The friction coefficient of the surface of the developing sleeve 51 can be lowered in the follow manner.

In the first embodiment, the low friction film 51*b* includes a ta-C film on the base pipe 51*a* using filtered cathodic vacuum arc (FCVA).

As a brief description of formation of the ta-C film, put high purity carbon (graphite), as a target, in a substantially vacuum chamber, and subject the target to arc discharge. Using electromagnetic induction, guide plasma generated by the arc discharge to the base pipe 51*a* of the developing sleeve 51. During the electromagnetic induction, remove substances, such as macro particles, neutral atoms, molecules, and the like that are unnecessary for deposition by an electromagnetic spatial filter and extract ionized carbon only. Then, the ionized carbon that reaches the surface of the base pipe 51*a* coagulates into a ta-C film.

Through the above-described processes, the low friction film 51*b* constructed of the ta-C film is formed on the base pipe 51*a*.

The low friction film 51*b* constructed of the ta-C film can be more uniform in thickness than films formed through plating or application. Further, since formable at a relatively low temperature, the ta-C film is less likely to be distorted by the temperature of the developing sleeve 51. Accordingly, the accuracy in shape of the developing sleeve 51 can be enhanced.

It is to be noted that, since deposition using FCVA is described in, for example, U.S. Pat. publication No. 6,031,239(A) and widely used in practice, detailed descriptions thereof are omitted.

Alternatively, the low friction film 51*b* on the base pipe 51*a* may be constructed of a TiN film by hollow cathode discharge (HCD).

Through ion plating, which is a type of physical vapor deposition (PVD), a film that excels in adhesion can be produced relatively easily. Among ion plating methods, HCD is particularly advantageous in producing a coating that is homogeneous and uniform in thickness along a surface roughness of a base material.

It is to be noted that, since deposition using HCD is described in, for example, Japanese patent publication Nos. JP-H10-012431-A and JP-H08-286516-A and widely used in practice, detailed descriptions thereof are omitted.

The low friction film 51*b*, which is the surface layer of the developing sleeve 51, is a thin coating of a material, such as tetrahedral amorphous carbon (ta-C), titanium nitride (TiN), or the like, that is lower in friction coefficient with toner than the base pipe 51*a*.

Needless to say, as long as lower in friction coefficient with toner than the base pipe 51*a* and agreeable with effects of this specification, the material of the low friction film 51*b* is not limited to ta-C and TiN but can be other materials such as titanium carbide (TiC), titanium carbonitride (TiCN), molybdic acid, or the like.

It is to be noted that, according to the measurement of friction coefficient (with paper belt) described below, the friction coefficient of aluminum alloy is about 0.5 or greater, that of TiN is about 0.3 to 0.4, that of ta-C is about 0.1 or smaller.

<Measurement of Friction Coefficient>

The friction coefficients of the surfaces of the developing sleeve 51 coated with the low friction film 51*b* and the developing sleeve without the low friction film 51*b* were measured using Euler's belt theory.

Figure 10:
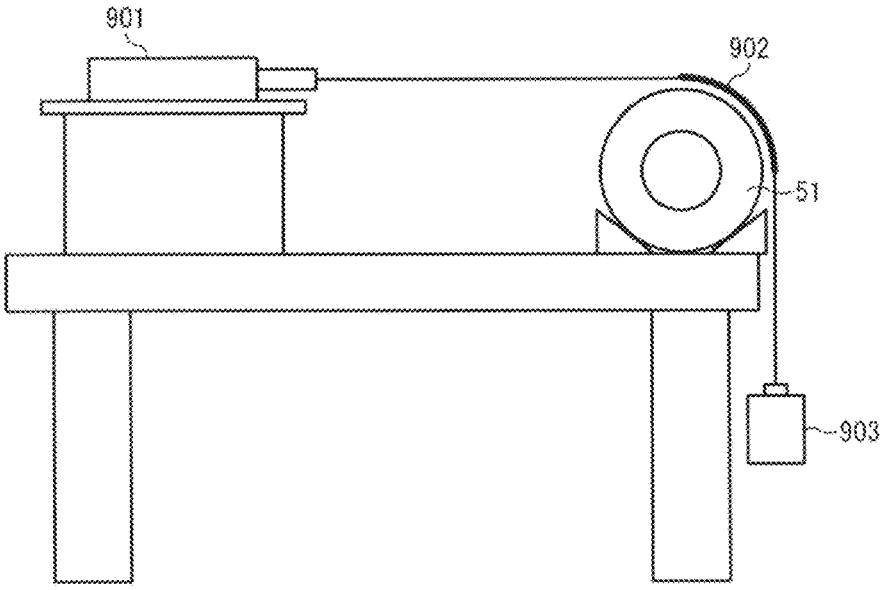
FIG. 10 is a schematic view illustrating a configuration of a friction coefficient measuring device.

FIG. 10 is a schematic view illustrating a configuration of a friction coefficient measuring device according to Euler's belt theory.

The measuring device shown in FIG. 10 includes a force gauge 901 (a digital push-pull gauge), a paper belt 902 constructed of fine paper of medium thickness, and a weight 903 (a load). The paper belt 902 is placed with a paper grain thereof in a longitudinal direction of the paper belt 902 and stretched one fourth of a circumference of the developing sleeve 51. The weight 903 weighs, for example, 0.98 N (100 grams) and is hung from one end of the belt 902, and the force gauge 901 is disposed at the other end of the paper belt 902.

In this configuration, while the force gauge 901 was pulled by the weight 903, a reading of load when the paper belt 902 moved was assigned in a formula of friction coefficient shown below:

$$\mu s=2/\pi\times 1n(F/0.98)$$

wherein μ represents a stationary friction coefficient and F represents a measured value.

Ghost images can arise as follows. While the surface of the developing sleeve 51 passes through the development range, a greater amount of toner adheres to a surface that has faced a non-image area on the photoreceptor 1 than a surface that has faced an image area on the photoreceptor 1. Since the toner adhering to the developing sleeve 51 has electrical charges, when the surface of the developing sleeve 51 bearing toner again reaches the development range and performs image development, the development potential is increased by the charge amount of toner present on the surface of the developing sleeve 51. As the amount of toner adhering increases, the increase in charge amount increases, and the development amount increases. Accordingly, the development amount is greater in the portion developed by the surface of the developing sleeve 51 that has faced the non-image area in the preceding image, thus resulting in a ghost image.

By contrast, in the developing device 5 according to the first embodiment, the occurrence of ghost images can be suppressed by providing the low friction film 51*b* on the surface of the developing sleeve 51. With the developing sleeve 51 coated with the low friction film 51*b*, the adhesion force between toner and carrier can be greater than that between toner and the developing sleeve 51, and accordingly the amount of toner adhering to the developing sleeve 51 decreases. This can suppress the increase in surface potential of the developing sleeve 51 caused by the toner adhering thereto and accordingly inhibit the occurrence of ghost images.

In the developing device 5 according to the first embodiment, the surface potential of the developing sleeve 51 fluctuates cyclically since the voltage in which the DC component is superimposed with the AC component is applied to the developing sleeve 51.

Descriptions are given below of a configuration in which a smallest potential on the negative side of the surface potential of the developing sleeve 51 that fluctuates cyclically is on the negative side from the exposed portion on the surface of the photoreceptor 1.

It is to be noted that the term "smallest potential on the negative side" (hereinafter "smallest negative potential") used here means a value closest to zero volt (0 V) in a case where the surface potential of the developing sleeve 51 fluctuates only on the negative side and a greatest value on the positive side in a case where the surface potential fluctuates in a range extending to the positive side.

Initially, the surface potential of the developing sleeve 51 and that of the photoreceptor 1 are described below.

In typical electrophotographic image forming apparatuses, the surface of the photoreceptor 1 is uniformly charged and then exposed by the exposure device, thereby forming an electrostatic latent image. At that time, the developing sleeve 51 is given a potential greater than that of the exposed portion of the electrostatic latent image, thereby attaining a potential difference to transfer toner from the developing sleeve 51 to the electrostatic latent image on the photoreceptor 1.

In the configuration in which the DC bias is applied to the developing sleeve 51, the surface potential of the developing sleeve 51 is constant since the voltage applied to the developing sleeve 51 is constant. Accordingly, an electrical field is generated only by a potential difference that transfers toner from the developing sleeve 51 to the exposed portion on the photoreceptor 1.

By contrast, in the configuration in which the AC bias including the AC component is applied to the developing sleeve 51, as in the developing device 5 according to the first embodiment, the surface potential of the developing sleeve 51 fluctuates cyclically in a minute period of time. Therefore, a potential difference that draws back toner from the photoreceptor 1 toward the developing sleeve 51 is generated as well, and, in the minute period, the electrical field that transfers toner from the developing sleeve 51 to the photoreceptor 1 alternates with an electrical field that draws back toner therefrom toward the developing sleeve 51.

Even when the electrical field that draws back toner from the photoreceptor 1 to the developing sleeve 51 is thus generated, toner can move to the electrostatic latent image when a potential difference to cause toner to the photoreceptor 1 is secured between an average potential of the AC bias and the potential of the exposed portion. If the potential difference 3 0 that draws back toner from the photoreceptor 1 to the developing sleeve 51 is large, a trace of returned toner remains in the toner image developed on the photoreceptor 1, and the exposed portion is not fully filled with toner. Such portions that are not fully filled with toner becomes portions where toner partially absent. Thus, image granularity (homogeneity or uniformity) can be lower than that in DC bias development.

In view of the foregoing, degradation in image uniformity can be inhibited by reducing the potential difference that draws back toner from the photoreceptor 1 to the developing sleeve 51 or inhibiting toner from returning to the developing sleeve 51.

(Second Embodiment)

A second embodiment of the developing device 5 is described below.

In the developing device 5 according to the second embodiment, the developing bias including the AC component is applied to the developing sleeve 51, the surface potential of the developing sleeve 51 fluctuates cyclically, and a surface potential of the developing sleeve 51 greatest in the positive direction (lowest in the graph shown in FIG. 11B) is on the negative side (on the upper side in FIG. 11B) from the potential of the image area (VL in FIG. 11B) of the photoreceptor 1. Except the above-described difference, the developing device 5 according to the second embodiment is similar in configuration and effect to the developing device 5 according to the first embodiment, and thus descriptions thereof are omitted.

In the developing device 5 according to the second embodiment, the surface potential of the developing sleeve 51 fluctuates cyclically and is constantly on the negative side relative to the image area of the photoreceptor 1. Accordingly, there is no action that draws back negatively charged toner from the photoreceptor 1 toward the developing sleeve 51. This configuration can inhibit degradation in image uniformity resulting from the application of the developing bias including the AC component to the developing sleeve 51.

EXPERIMENT 3

Descriptions are given below of experiment 3 executed to evaluate degradation in image uniformity in solid images in the configuration that causes the potential difference to draw back toner from the photoreceptor 1 to the developing sleeve 51 and the configuration that does not cause such a potential difference.

In the description regarding experiment 3, the terms "largest negative potential Vpp1" and "smallest negative potential Vpp2" respectively mean a largest potential and a smallest potential on the negative side of the peak-to-peak (Vpp) potential of the developing bias fluctuating due to the AC component. Additionally, the term "exposed potential VL" means the surface potential of the electrostatic latent image (exposed portion) of the solid image. In experiment 3, in example configuration (hereinafter "configuration 2" of the second embodiment was compared with comparative example 4 in which the smallest negative potential Vpp2 was set to cause a potential difference, between the exposed potential VL and the smallest negative potential Vpp2, to draw back toner to the developing sleeve 51. In configuration 2, the smallest negative potential Vpp2 was set not to cause the potential difference to draw back toner to the developing sleeve 51.

Figure 11A:
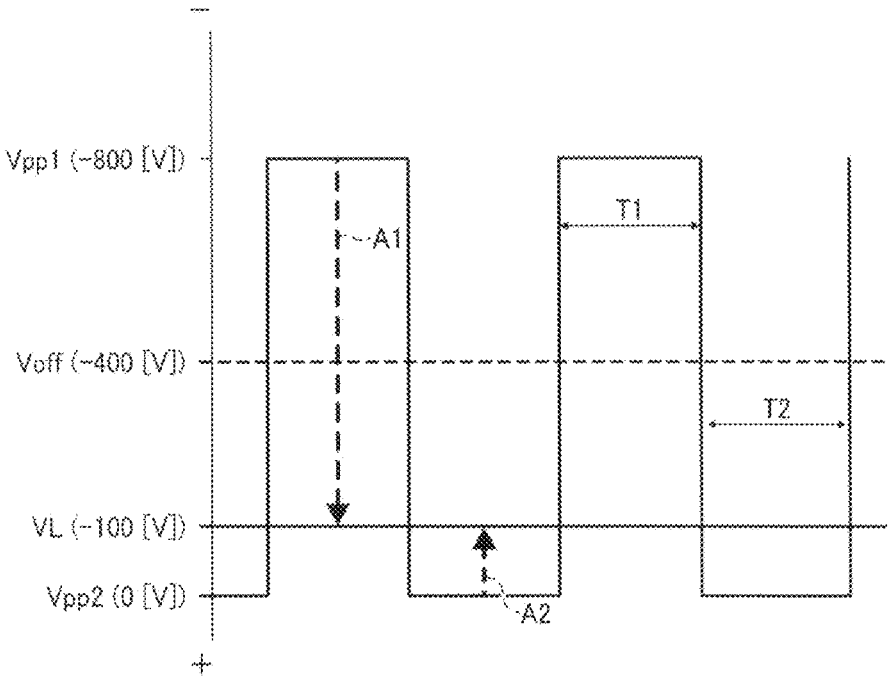
FIGS. 11A and 11B are graphs illustrating relations between a potential of an exposed portion and a surface potential of a developing sleeve in experiment 3.
Figure 11B:
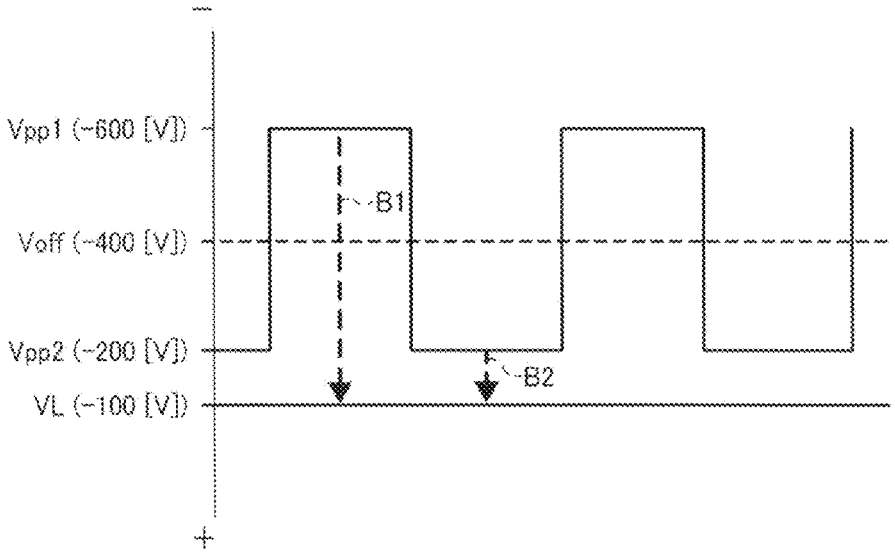

FIGS. 11A and 11B are graphs illustrating relations between the exposed potential VL and the surface potential of the developing sleeve 51 that fluctuates cyclically over time. FIG. 11A illustrates the relation in comparative example 4, and FIG. 11B illustrates the relation in configuration 2. In FIGS. 11A and 11B, reference character Voff represents the DC component (offset) of the developing bias.

COMPARATIVE EXAMPLE 4

Conditions of comparative example 4 are as follows.

Image forming apparatus: Modification of Ricoh imagio MP C5000; Developer: Yellow;

Developing sleeve: Aluminum sleeve coated with ta-C (0.6 μm with deviation of 0.3 μm);

Developing bias: DC component and AC component superimposed thereon;

Frequency of AC component: 5 kHz;

Amplitude of AC component (peak-to-peak): 800 V;

Duty ratio of AC component: 50%; and

DC component voltage (offset): −400 V (Configuration 2)

Conditions of configuration 2 are as follows.

Image forming apparatus: Modification of Ricoh imagio MP C5000;

Developer: Yellow

Developing sleeve: Aluminum sleeve coated with ta-C (0.6 μm with deviation of 0.3 μm); and Developing bias: DC component and AC component superimposed thereon;

Frequency of AC component: 5 kHz;

Amplitude of AC component (peak-to-peak): 400 V;

Duty ratio of AC component: 50%; and

DC component voltage (offset): −400 V

As shown in FIG. 11B, in the developing device 5 according to the second embodiment, the developing bias including the AC component is applied to the developing sleeve 51, and the smallest negative potential Vpp2, which is the value closest to the positive side in the cyclically fluctuating surface potential of the developing sleeve 51, is −200 V. This value is on the negative side from the potential of the image area (i.e., the exposed portion) of the photoreceptor 1.

Figure 12A:
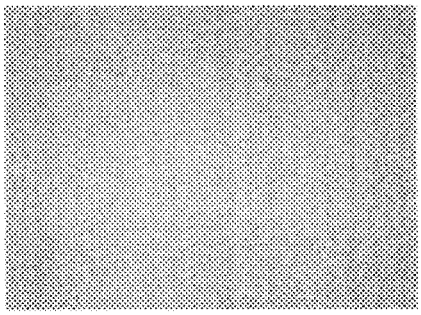
FIG. 12A is a photograph of a solid toner image on a photoreceptor under conditions according to an embodiment.
Figure 12B:
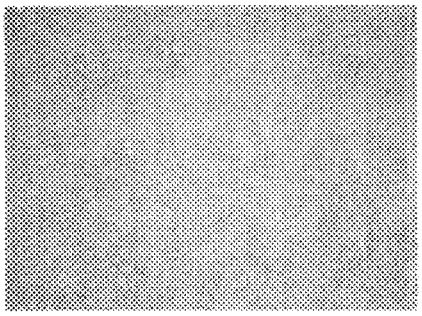
FIG. 12B is a photograph of a solid toner image on a photoreceptor under comparative conditions.

FIGS. 12A and 12B are photographs taken by a Keyence laser microscope, VK9500, and show states of toner (yellow toner) adhering to the solid images on the photoreceptor 1 in experiment 3. FIG. 12A is a photograph of the surface of the photoreceptor 1 in configuration 2, and FIG. 12B is a photograph of that in comparative example 4.

Table 2 shows conditions and results of experiment 3.

TABLE 2

| | Configuration 2 | Comparative example 4 |
|---|---|---|
| Frequency (kHz) | 5 | 5 |
| Vpp (V) | 400 | 800 |
| Duty ratio (%) | 50 | 50 |
| Voff (V) | −400 | −400 |
| Uniformity | Good | Bad |

In comparative example 4, as shown in FIG. 11A, toner moves from the developing sleeve 51 to the photoreceptor 1 as indicated by arrow A1 at the timing at which the developing bias is at the largest negative potential Vpp1. At the timing at which the developing bias is at the smallest negative potential Vpp2, toner returns from the photoreceptor 1 to the developing sleeve 51 as indicated by arrow A2 since the smallest negative potential Vpp2 is on the positive side from the exposed potential VL. It can be known that image uniformity can be lowered by the potential difference that draws back toner from the photoreceptor 1 to the developing sleeve 51.

In a period in which the AC developing bias is on the positive side from the exposed potential VL as shown in FIG. 11A, instantaneously the electrical field that draws back toner adhering to the photoreceptor 1 to the developing sleeve 51 occurs. Since toner is strongly returned in a portion where carrier contacts the toner image on the photoreceptor 1, the density defers between the portion that carrier contacts and the portion contactless with carrier. In a macroscopic view, it becomes degradation of granularity, thus degrading image uniformity.

By contrast, in configuration 2, similarly to comparative example 4, toner moves from the developing sleeve 51 to the photoreceptor 1 as indicated by arrow B1 in FIG. 11B at the timing at which the developing bias is at the largest negative potential Vpp1. At the timing at which the developing bias is at the smallest negative potential Vpp2, differently from comparative example 4, toner moves from the developing sleeve 51 to the photoreceptor 1 as indicated by arrow B2 since the smallest negative potential Vpp2 is on the negative side of the exposed potential VL. In other words, the smallest negative potential Vpp2 is greater in the direction of the toner normal charge polarity than the exposed potential VL. Thus, the potential difference that draws back toner from the photoreceptor 1 to the developing sleeve 51 does not occur, thus inhibiting degradation in image uniformity.

In the second embodiment capable of inhibiting degradation of image uniformity resulting from application of the developing bias including AC component, the following formula is satisfied.

$$|Vpp1|>|Vpp2|>|VL| \quad \text{Formula 1}$$

Here, it is assumed that, in the peak-to-peak (Vpp) potential of the developing bias fluctuating due to the AC component, the highest and the lowest on the side of normal toner charge polarity are referred to as "largest potential VppA on toner polarity side" and "smallest potential VppB on toner polarity side", respectively. Additionally, VL represents the potential of the exposed portion on the photoreceptor 1. When the potential is compared deeming that the toner normal charge polarity is on the positive side, degradation of image uniformity can be inhibited by applying the AC developing bias that satisfies the following formula.

$$|VppA|>|VppB|>|VL| \quad \text{Formula 2}$$

Since the developing device 5 according to the second embodiment satisfies the formula 2 above, degradation of image uniformity can be suppressed. Additionally, similarly to the first embodiment, the occurrence of ghost images can be inhibited by providing the developing sleeve 51 with the coating to which toner is less likely to adhere, and image density unevenness resulting from the thickness unevenness of the coating can be inhibited by applying the AC developing bias including the AC component to the developing sleeve 51. Thus, the developing device 5 according to the second embodiment can inhibit the occurrence of ghost images, image density unevenness, and degradation of image uniformity; and accordingly capable of more reliable image formation.

(Third Embodiment)

A third embodiment of the developing device 5 is described below.

In the developing device 5 according to the third embodiment, regarding the AC component of the developing bias applied to the developing sleeve 51, application time of the positive polarity component is shorter than application time of the negative polarity component, which is on the same side as the toner normal charge polarity. Except the above-described difference, the developing device 5 according to the present embodiment is similar in configuration and effect to the developing device 5 according to the first embodiment, and thus descriptions thereof are omitted.

Figure 13:
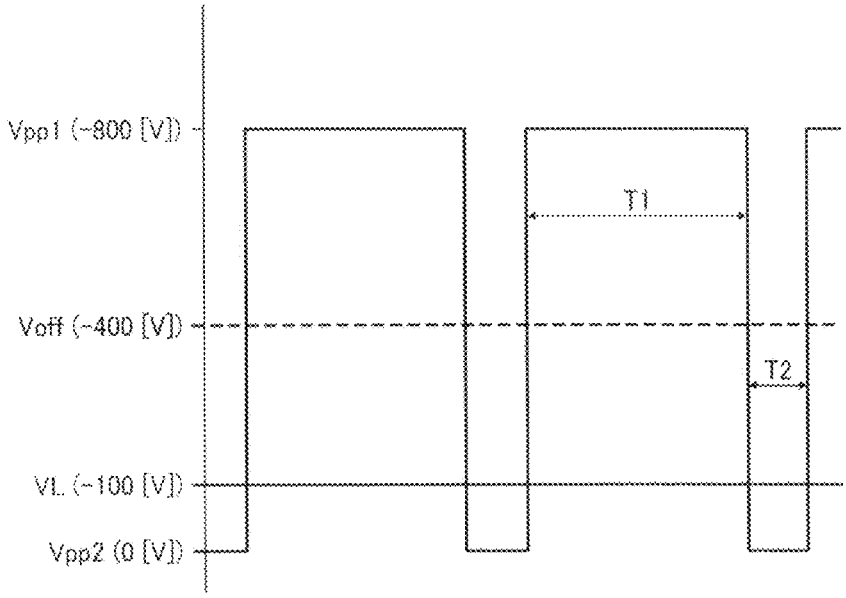
FIG. 13 is graph illustrating relations between the potential of the exposed portion and the surface potential of the developing sleeve according to a third embodiment.

FIG. 13 is graph illustrating relations between the exposed potential VL and the surface potential of the developing sleeve 51 that fluctuates cyclically over time in the developing device 5 according to the third embodiment.

As in the above-described second embodiment, when the peak-to-peak Vpp of the developing bias including AC component is reduced to inhibit degradation of image uniformity, the developability decreases. That is, it is necessary to increase the potential difference to develop the latent image with toner, and saturation development becomes difficult. A conceivable approach in view of the foregoing is to increase the period of the largest potential VppA on the toner polarity side. It is conceivable that, even if the potential difference that draws back toner from the photoreceptor 1 to the developing sleeve 51 shown in FIG. 11A is caused, the period of the potential that contributes to development is made as long as possible in the waveshape of the developing bias as shown in FIG. 13. With this configuration, an average potential of the developing bias (hereinafter "developing bias average potential Vave") can be high on the toner normal polarity side, and thus the developability can be secured.

To keep the period of the potential that contributes to development as long as possible, regarding the AC component of the voltage applied to the developing sleeve 51, the duty ratio of a component on the polarity (hereinafter also "opposite polarity component" and positive in the present embodiment) opposite the toner normal charge polarity is made smaller. With this configuration, when the toner normal charge polarity is negative, the negative component of the duty ratio of the developing bias can be increased, and the positive component can be reduced.

Referring to FIG. 13, T1 represents a period during which the largest negative potential Vpp1 is applied, and T2 represents a period during which the smallest negative potential Vpp2 is applied. A duty ratio D1 (%) of the period during which negative side voltage, which is on the side identical to the toner normal charge polarity, is applied is determined by the following formula. The duty ratio D1 is hereinafter also referred to as "negative side duty ratio D1".

$$D1=T1/(T1+T2)\times 100 \quad \text{Formula 3}$$

Additionally, a duty ratio D2 (%) of the period during which positive side voltage (hereinafter also "positive side duty ratio D2"), opposite the toner normal charge polarity, is applied is determined by the following formula.

$$D2=T2/(T1+T2)\times 100 \quad \text{Formula 4}$$

Additionally, the duty ratio D2 during which positive side voltage, on the opposite side of the toner normal charge polarity, is applied is preferably 20% or shorter.

When the period T1 and the period T2 satisfy the following formula, the positive side duty ratio D2 can be 20% or shorter.

$$T2/(T1+T2)\times 100\leq 20 \quad \text{Formula 5}$$

Under a center condition within a toner density control range (for example, 7% in the present embodiment), when a development threshold voltage is 0 V, it is desirable that a developing potential difference (|Vave−VL|) is 400 V or lower to attain an image density of 1.5.

Figure 14:
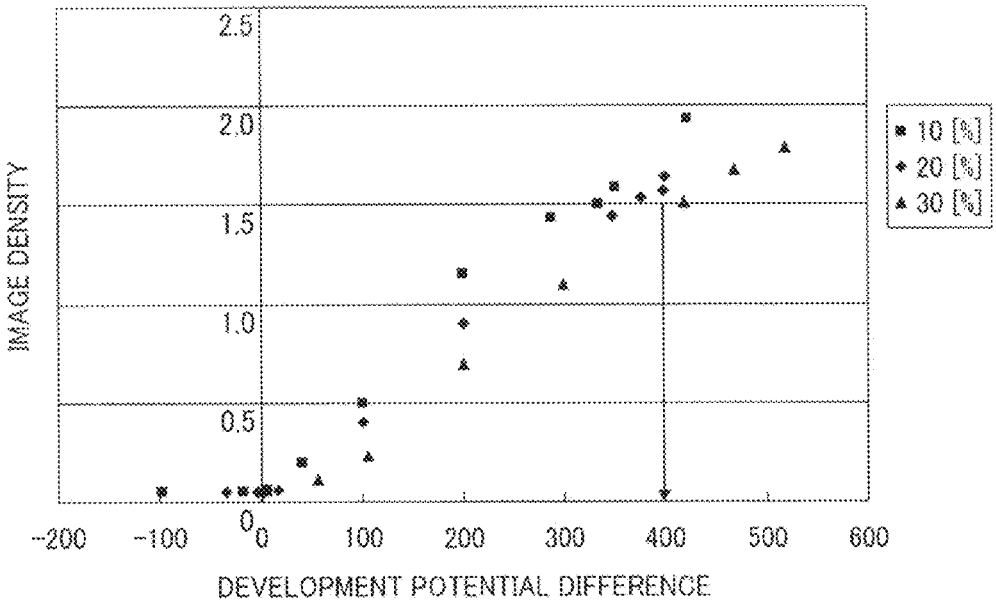
FIG. 14 is a graph illustrating the relation between differences in developing potential and image density in a case where the duty ratio of positive side voltage as an alternating current (AC) component is varied.

FIG. 14 is a graph illustrating the relation between the developing potential difference and the image density in a case where the duty ratio D2, which is the ratio of period during which the positive side voltage is applied as the AC component, is varied from 10% to 30%.

According to the results shown in FIG. 14, the positive side duty ratio D2 is preferably 20% or shorter. When the developing potential difference exceeds 600 V, carrier adhering to the photoreceptor 1 starts to cause image defects. Accordingly, it is preferred that the developing potential difference be 400 V or lower under the center condition to prevent the developing potential difference from rising to 600 V due to fall of toner density, temperature change, humidity change, or combinations thereof.

Additionally, the frequency of the AC component is preferably 5 kHz or lower. When the frequency is higher than that, it is possible that toner fails to fully follow the waveshape of the developing bias and an intended function is not attained.

According to the first through third embodiments, the low friction film 51*b* is provided on the base pipe 51*a* of the developing sleeve 51 to inhibit adhesion of toner to the developing sleeve 51. This configuration can inhibit the occurrence of ghost images since the developing potential is not increased by the adhesion of toner. Additionally, although the thickness unevenness of the low friction film 51*b* may result in image density unevenness in the configuration in which the developing bias includes DC component only, the application of the AC developing bias can attain development close to saturation development, thus inhibiting image density unevenness.

The image forming apparatus 500 including the developing device 5 configured as described above can inhibit both of ghost images and cyclic image density unevenness and accordingly attain desirable image formation in which image density is stable.

Additionally, when the image forming unit 6 including the developing device 5 is configured as the process cartridge removable and installable in the apparatus body (I.e., the printer unit 100 shown in FIG. 2), replacement of the developing device 5 capable of stabilizing image density is facilitated.

To inhibit degradation of image uniformity resulting from application of the developing bias including AC component, as in the second embodiment, the developing bias is set such that the smallest negative potential Vpp2 of the developing sleeve 51 to which the developing bias is applied is greater on the negative side than the exposed potential VL. This setting can eliminate or inhibit the action to draw back toner from the photoreceptor 1 to the developing sleeve 51, and thus degradation of image uniformity can be suppressed.

As in the third embodiment, when the positive side duty ratio D2 of the AC component of the developing bias is made smaller than the negative side duty ratio D1, the action to draw back toner from the photoreceptor 1 to the developing sleeve 51 can be inhibited. This setting can inhibit degradation in image uniformity resulting from application of the developing bias including the AC component to the developing sleeve 51.

(Fourth Embodiment)

A fourth embodiment of the developing device 5 is described below.

In the fourth embodiment, the developing device 5 is provided with a duty ratio controller to control, according to the image area ratio of the image to be developed, the duty ratio of the AC component of the developing bias applied to the developing sleeve 51. For example, the duty ratio controller can be the controller 60 shown in FIG. 2. Except the above-described difference, the developing device 5 according to the present embodiment is similar to the developing device 5 according to the first embodiment, and thus descriptions thereof are omitted.

EXPERIMENT 4

Here, descriptions are given below of experiment 4 to ascertain the occurrence of image density unevenness and degradation of image uniformity while the positive side duty ratio D2 of the AC component of the developing bias.

Figure 15:
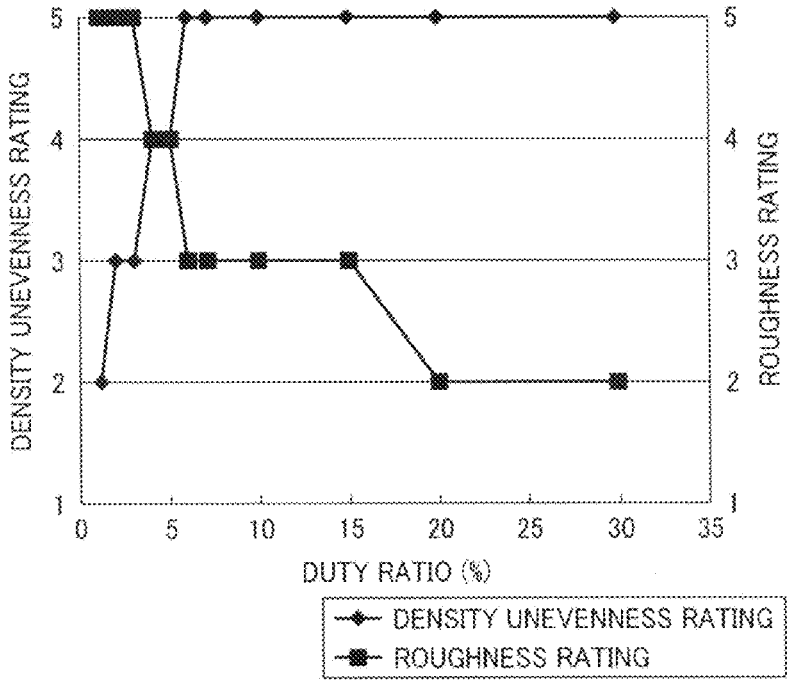
FIG. 15 is a graph illustrating results of experiment 4.

FIG. 15 is a graph illustrating results of experiment 4.

Specifically, FIG. 15 shows ratings of image density unevenness and image uniformity when the positive side duty ratio D2 of the AC component of the developing bias is varied within a range from 1% to 30%. In experiment 4, an image having an image area ratio of 75% was used for image density unevenness ratings, and an image having an image area ratio of 30% was used for degradation of image uniformity ratings.

Conditions of experiment 4 are as follows.

Image forming apparatus: Modification of Ricoh imagio MP C5000;

Developer: Cyan;

Developing sleeve: Aluminum sleeve coated with ta-C (0.6 μm with deviation of 0.3 μm);

Developing bias: DC component and AC component superimposed thereon;

Frequency of AC component: 1 kHz;

Amplitude of AC component (peak-to-peak): 800 V;

Duty ratio of positive side of AC component: 1% to 30%; and

DC component: Adjusted to attain an image density of 1.5

Ratings of degradation of image uniformity (on image area ratio of 30%) and image density unevenness (on image area ratio of 75%) are as follows.

5: Not observed;

4: No problem;

3: Acceptable;

2: Not acceptable; and

1: Bad (worse than 2)

As shown in FIG. 15, image density unevenness is alleviated as the duty ratio on the positive side of the AC component increases. By contrast, degradation of image uniformity is alleviated as the duty ratio on the positive side of the AC component decreases. That is, there is trade-off between image density unevenness and degradation of image uniformity regarding the duty ratio on the positive side of the AC component of the developing bias. Thus, it is difficult to attain a highest rating in both of image density unevenness and degradation of image uniformity.

When the image area ratio is small, however, image density unevenness is less perceivable and degradation of image uniformity is more perceivable. Therefore, when the image area ratio is small, inhibiting degradation of image uniformity deserves priority over inhibiting image density unevenness in selecting the developing bias. By contrast, when the image area ratio is large, image density unevenness is more perceivable, and thus inhibiting image density unevenness deserves priority in selecting the developing bias. Therefore, images can be optimized according to the image area ratio by adjusting, according to the image area ratio, the positive side duty ratio D2 of the AC component of the developing bias applied by the power source 151.

Figure 16:
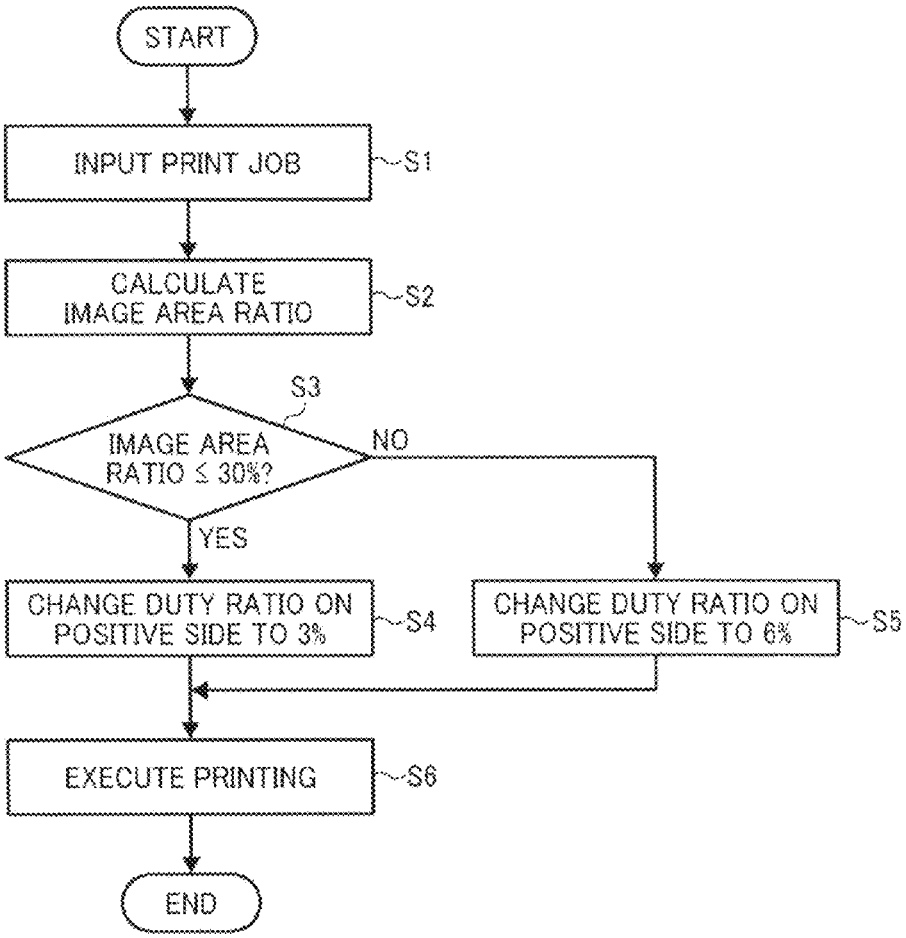
FIG. 16 is a flowchart of printing control in an image forming apparatus including a developing device according to a fourth embodiment.

FIG. 16 is a flowchart of printing control in the image forming apparatus 500 including the developing device 5 according to the fourth embodiment.

In the control operation shown in FIG. 16, the positive side duty ratio D2 is set to a smaller setting when the image area ratio is equal to or smaller than a threshold, which is 30%, for example. When the image area ratio is greater than the threshold, the positive side duty ratio D2 is set to a larger setting.

Referring to FIG. 16, at S1 when a print job is input to the image forming apparatus 500, the controller 60, which also serves as the duty ratio controller, calculates the image area ratio of the print job at S2. At S3, the controller 60 judges whether the calculated image area ratio is 30% or smaller. The image area ratio may be calculated using moving average of image area ratio.

When the image area ratio is 30% or smaller (Yes at S3), at S4, the positive side duty ratio D2 of the AC component of the developing bias is set at 3%, and printing is performed at S6. By contrast, when the image area ratio is greater than 30% (No at S3), at S5, the positive side duty ratio D2 of the AC component of the developing bias is set at 6%, and printing is performed at S6.

When the positive side duty ratio D2 of the AC component of the developing bias is 6% or greater, the image density unevenness can be an acceptable level, but the positive side duty ratio D2 is preferably smaller to inhibit degradation of image uniformity.

With the developing device 5 according to the fourth embodiment, the occurrence of ghost images can be inhibited by providing the developing sleeve 51 with the coating to which toner is less likely to adhere, and image density unevenness resulting from the thickness unevenness of the coating can be inhibited by applying the developing bias including the AC component thereto. Additionally, degradation of image uniformity, which is inherent to AC bias development, can be inhibited by setting the positive side duty ratio D2 of the AC component of the developing bias to a value smaller than the negative side duty ratio D1. Additionally, optimum images can be produced by setting the developing bias conditions to those effective in alleviating degradation of image uniformity for images (susceptible to degradation of image uniformity visibility) in which degradation of image uniformity can be more noticeable and those effective in alleviating image density unevenness for images (susceptible to density unevenness visibility) in which image density unevenness can be more noticeable.

For example, when the image area ratio is small, image density unevenness is less perceivable and degradation of image uniformity is more perceivable. Accordingly, in this case, optimum images can be attained with the developing bias conditions effective in inhibiting degradation of image uniformity. Specifically, toner is drawn to the developing sleeve 51 from the electrostatic latent image on the photoreceptor 1 at application timing of voltage to draw toner to the developing sleeve 51 in the developing bias including the AC component. Images uniformity can be lowered by the action to draw toner from the photoreceptor 1 to the developing sleeve 51.

Degradation of image uniformity can be alleviated by configuring the developing bias conditions such that, in the waveshape of the developing bias, a waveshape portion to draw back toner to the developing sleeve 51 less draws back toner. In short, the developing bias including the AC component is applied to the developing sleeve 51 provided with a coating that inhibits charge of toner. Additionally, multiple types of developing bias conditions are provided: one is effective in inhibiting image density unevenness and another is effective in improving granularity. According to image data, suitable developing bias conditions can be selected among the multiple developing bias conditions.

In the fourth embodiment, according to the image area ratio, the duty ratio of the AC component of the developing bias applied to the developing sleeve 51 can be selected from the one advantageous in alleviating image density unevenness and another one advantageous in alleviating degradation of image uniformity. Thus, optimum images according to the image area ratio can be attained.

It is to be noted that, although aluminum is used as the material of the developing sleeve 51 (the base pipe 51*a* in particular) in the above-described embodiments, the material is not limited thereto but can be selected from those conductive, nonmagnetic, and having a strength capable of maintaining a cylindrical shape. When a material other than aluminum is used, the low friction film 51*b* serving as the low friction surface layer includes or is made of a material lower in friction coefficient with toner than the material of the base pipe 51*a* of the developing sleeve 51.

The various aspects of the present specification can attain specific effects as follows.

Aspect A: A developing device includes a developer bearer, such as the developing roller 50, to carry, by rotation, developer including toner and magnetic carrier to a development range facing a latent image bearer, such as the photoreceptor 1, and to supply the developer to a latent image on the latent image bearer. The developer bearer includes a magnetic field generator, such as the magnet roller 55, having multiple magnetic poles and a cylindrical developing sleeve, such as the developing sleeve 51, to contain the magnetic field generator, bear developer on an outer circumferential face thereof with magnetic force of the magnetic field generator, and rotate relative to a body of the device. The outer circumferential face of the developing sleeve is provided with a low friction surface layer, such as the low friction film 51*b*, constructed of a material lower in friction coefficient with toner than a material of a base, such as the base pipe 51*a*, that maintains a cylindrical shape of the developing sleeve. The developing device is further provided with a voltage application device, such as the power source 151, to apply, to the developing sleeve, developing bias voltage including an AC component.

In this configuration, as described above with reference to the first embodiment, providing the low friction surface layer can inhibit adhesion of toner to the developing sleeve. Accordingly, this configuration can inhibit the occurrence of ghost images resulting from the smeary sleeve. Additionally, the inventors have found that, compared with application of voltage consisting the DC component, application of the voltage including the AC component can better inhibit fluctuations in developability caused by thickness unevenness of the low friction surface layer. Thus, this configuration can inhibit the occurrence of cyclic image density unevenness corresponding to the thickness unevenness of the low friction surface layer. Thus, aspect A can inhibit the occurrence of cyclic image density unevenness while inhibiting the occurrence of ghost images.

Aspect B: In aspect A, the developing bias voltage includes a DC component and an AC component superimposed thereon, a surface potential of the developing sleeve changes cyclically by application of the developing bias voltage, and a smallest surface potential (i.e., the smallest negative potential Vpp2) of the developing sleeve in a direction of the toner normal charge polarity (negative in the embodiment) is greater in the direction of the toner normal charge polarity than a potential of a portion (i.e., the exposed portion) to be supplied with toner, on a surface of the latent image bearer.

As described above with reference to the second embodiment, aspect B can inhibit generation of the potential different to draw back toner from the latent image bearer to the developing sleeve, and degradation of image uniformity can be inhibited, thus securing reliable development.

Aspect C: In aspect A or B, in the AC component of the voltage applied to the developing sleeve, the duty ratio of the opposite polarity component, the polarity of which is opposite the toner normal charge polarity, is applied is 20% or smaller.

According to aspect C, as described above with reference to the third embodiment, regarding the voltage applied to the developing sleeve 51, the duty ratio of a component on the toner normal charge polarity can increase, thereby securing the developability. Additionally, the developing bias can be used with the developing potential difference not to cause adhesion of carrier to the latent image bearer. Accordingly, image formation can be reliable with image defects suppressed.

Aspect D: In any of aspects A through C, the developing device is provided with a duty ratio controller to control, according to the image area ratio of an image to be developed, the duty ratio of the AC component of the developing bias applied to the developing sleeve by the voltage application device such as the power source 151.

With this configuration, as described above with reference to the fourth embodiment, optimum images according to the image area ratio can be attained.

Aspect E: In aspect D, when the image area ratio of the image to be developed is 30% or smaller, the duty ratio controller sets the duty ratio of the opposite polarity component (opposite the toner normal charge polarity) of the AC component of the voltage applied to the developing sleeve to 3% or smaller.

With aspect E, as described above with reference to the fourth embodiment, when images susceptible to degradation of image uniformity visibility are output, the voltage applied to the developing sleeve is set under conditions effective in alleviating degradation of image uniformity, thereby offering optimum images to users.

Aspect F: In any of aspects A through E, a base, such as the base pipe 51*a*, of the developing sleeve includes or can be made of aluminum.

With this configuration, as described above with reference to the first embodiment, a nonmagnetic and conductive developing sleeve can be attained.

Aspect G: In any of aspects A through F, the low friction surface layer such as the low friction film 51*b* includes or can be made of tetrahedral amorphous carbon.

With this configuration, as described above with reference to the first embodiment, the low friction surface layer can be lower in friction coefficient with toner than the base of the developing sleeve.

Aspect H: An image forming apparatus, such as the image forming apparatus 500 shown in FIG. 2, includes the latent image bearer, a charging device to charge the surface of the latent image bearer, an exposure device to form an electrostatic latent image on the latent image bearer, and the developing device according to any of aspects A through G.

This configuration can inhibit both of ghost images and cyclic image density unevenness and accordingly attain desirable image formation in which image density is stable.

Aspect I: A process cartridge, such as the image forming unit 6, removably installed in an image forming apparatus, includes at least the latent image bearer, the developing device according to any of aspects A through G, and a common unit casing to house those components.

This configuration can facilitate replacement of the developing device 5 capable of stabilizing image density.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developing device comprising:

a developer bearer to carry, by rotation, developer including toner and magnetic carrier to a development range facing a latent image bearer to bear a latent image, the developer bearer including:

a magnetic field generator having multiple magnetic poles; and a cylindrical developing sleeve to rotate and bear developer on an outer circumferential face thereof with magnetic force of the magnetic field generator provided inside the developing sleeve, the developing sleeve to receive developing bias voltage including an AC component, the developing sleeve including:

a base to maintain a cylindrical shape of the developing sleeve, and a low friction surface layer including a material lower in friction coefficient with toner than a material of the base, wherein the low friction surface layer comprises tetrahedral amorphous carbon.

2. The developing device according to claim 1, wherein the developing bias voltage comprises a DC component and an AC component superimposed thereon, a surface potential of the developing sleeve changes cyclically by application of the developing bias voltage, and a smallest surface potential of the developing sleeve in a direction of a toner normal charge polarity is greater in the direction of the toner normal charge polarity than a potential of an exposed portion on a surface of the latent image bearer.

3. The developing device according to claim 1, wherein, in the AC component of the developing bias voltage, a duty ratio of an opposite polarity component, a polarity of which is opposite a toner normal charge polarity, is 20% or smaller.

4. The developing device according to claim 1, wherein the base of the developing sleeve comprises aluminum.

5. A process cartridge removably installed in an image forming apparatus, the process cartridge comprising:

the latent image bearer;

the developing device according to claim 1, to develop the latent image on the latent image bearer; and a common unit casing to hold the latent image bearer and the developing device as a single unit.

6. An image forming apparatus comprising:

a latent image bearer to bear a latent image thereon;

a developing device to develop the latent image with developer including toner and magnetic carrier to form a toner image, the developing device including a developer bearer to carry, by rotation, developer including toner and magnetic carrier to a development range facing a latent image bearer, the developer bearer including:

a magnetic field generator having multiple magnetic poles; and a cylindrical developing sleeve to rotate and bear developer on an outer circumferential face thereof with magnetic force of the magnetic field generator provided inside the developing sleeve, the developing sleeve including a base to maintain a cylindrical shape of the developing sleeve and a low friction surface layer including a material lower in friction coefficient with toner than a material of the base;

a voltage application device to apply, to the developing sleeve, developing bias voltage including an AC component; and a duty ratio controller to control, according to an image area ratio of an image to be developed, a duty ratio of the AC component of a developing bias voltage, wherein when the image area ratio is 30% or smaller, in the AC component of the developing bias voltage, the duty ratio controller sets a duty ratio of an opposite polarity component, a polarity of which is opposite a toner normal charge polarity, to 3% or smaller.

7. An image forming apparatus comprising:

a latent image bearer to bear a latent image thereon;

a developing device to develop the latent image with developer including toner and magnetic carrier to form a toner image, the developing device including a developer bearer to carry, by rotation, developer including toner and magnetic carrier to a development range facing a latent image bearer, the developer bearer including:

a magnetic field generator having multiple magnetic poles; and a cylindrical developing sleeve to rotate and bear developer on an outer circumferential face thereof with magnetic force of the magnetic field generator provided inside the developing sleeve;

a voltage application device to apply, to the developing sleeve, developing bias voltage including an AC component; and a duty ratio controller to control, according to an image area ratio of an image to be developed, a duty ratio of the AC component of a developing bias voltage, wherein when the image area ratio is 30% or smaller, in the AC component of the developing bias voltage, the duty ratio controller sets a duty ratio of an opposite polarity component, a polarity of which is opposite a toner normal charge polarity, to 3% or smaller.

* * * * *